US008146672B2

(12) United States Patent
Eriksen

(10) Patent No.: US 8,146,672 B2
(45) Date of Patent: Apr. 3, 2012

(54) METHOD AND APPARATUS FOR RETRIEVING AND INSTALLING A DRILL LOCK ASSEMBLY FOR CASING DRILLING

(75) Inventor: Erik P. Eriksen, Calgary (CA)

(73) Assignee: Tesco Corporation, Houston, TX (US)

( * ) Notice: Subject to any disclaimer, the term of this patent is extended or adjusted under 35 U.S.C. 154(b) by 572 days.

(21) Appl. No.: 12/275,396

(22) Filed: Nov. 21, 2008

(65) Prior Publication Data

US 2010/0126734 A1 May 27, 2010

(51) Int. Cl.
*E21B 23/00* (2006.01)

(52) U.S. Cl. ..... 166/381; 175/171; 175/257; 166/98

(58) Field of Classification Search ..... 175/171, 175/257; 166/98, 381
See application file for complete search history.

(56) References Cited

U.S. PATENT DOCUMENTS

| | | | | |
|---|---|---|---|---|
| 3,350,130 | A * | 10/1967 | Ahlstone | 294/86.25 |
| 4,295,528 | A * | 10/1981 | Carmody | 166/382 |
| 4,745,974 | A | 5/1988 | Higgins | |
| 4,898,245 | A | 2/1990 | Braddick | |
| 5,826,652 | A | 10/1998 | Tapp | |
| 7,182,153 | B2 * | 2/2007 | Moriarty | 175/61 |
| 7,360,594 | B2 * | 4/2008 | Giroux et al. | 166/242.6 |
| 7,775,302 | B2 * | 8/2010 | Warren | 175/260 |
| 7,845,417 | B2 * | 12/2010 | Warren et al. | 166/377 |

* cited by examiner

*Primary Examiner* — Nicole Coy
(74) *Attorney, Agent, or Firm* — Bracewell & Giuliani LLP

(57) ABSTRACT

A method of installing a drilling tool at a lower end of a string of casing suspended in a borehole employs a setting tool run by wireline. The setting tool is latched to a drilling tool connected a drill lock assembly. After landing in a profile sub at the lower end of the casing, fluid pressure is applied to the interior of the string of casing to actuate the setting tool. The setting tool moves to latch the drill lock assembly to the sub so that torque may be transmitted between the profile sub and the drill lock assembly. The setting tool movement also releases the setting tool from the drill lock assembly for retrieval.

20 Claims, 19 Drawing Sheets

METHOD AND APPARATUS FOR RETRIEVING AND INSTALLING A DRILL LOCK ASSEMBLY FOR CASING DRILLING

FIELD OF THE INVENTION

This invention relates in general to drilling wells with a string of casing, and in particular to a method and an apparatus for installing and retrieving a drill lock apparatus and drill bit from the lower end of the casing.

BACKGROUND OF THE INVENTION

Most oil and gas wells are drilled using drill pipe. At selected depths and at the total depth, the operator removes the drill pipe and drill bit, then lowers a string of casing into the wellbore and cements it in place. If the operator needs to replace the drill bit, he trips the drill bit out of the wellbore with the drill pipe, then runs the drill bit back into the wellbore with the drill pipe.

Another approach, referred to as casing drilling, involves the use of the casing as the drill string rather than drill pipe. The drill bit may be secured to the lower end of the casing and cemented in place along with the casing after reaching the desired depth. Alternately, the operator may use a retrievable drill bit assembly. The drilling is accomplished by rotating the casing with a top drive of the drilling rig. Drilling may also be accomplished using a mud motor, which rotates the drill bit relative to the casing.

In current techniques, retrievable drill bits are connected to a drill lock assembly, which is run through the casing to a profile sub at the lower end of casing. The drill lock assembly has a set of stop dogs that are biased outward and land on a shoulder provided in the profile sub. The drill lock assembly also has torque keys that are biased outward for engaging longitudinal slots provided in the profile sub. In addition, the drill lock assembly has an axial lock mechanism that is moved outward into engagement with a profile in the profile sub to prevent upward movement of the drill lock assembly in the profile sub. The drill lock assembly may be run by wireline, drill pipe, or it may be pumped into and out of the casing. If the drill lock assembly is to be run by wireline, a wireline running tool is used to lower the drill lock assembly into the profile sub, set it, then release from it to be retrieved back to the surface.

To retrieve the drill lock assembly by wireline, the operator attaches a retrieval tool to the wireline, lowers it into engagement with the drill lock assembly, releases the drill lock assembly from the profile sub, and retrieves it to the surface. Similarly, if drill pipe is utilized, a retrieval tool is employed for retrieving.

Generally, the drill lock assembly and running tools are complex, having many parts that must operate correctly. The environment in which the drill lock assembly is located is severe, having drilling mud and cuttings that may accumulate on top of the drill lock assembly. Further, lost circulation material is often added to mud used in casing drilling operations and it has the ability to hamper or foul operation of mechanical tools. Casing drilling is often used in wells with severe lost circulation problems. Provisions must be made for retrieving the drill lock assembly in the event that it is stuck and can not be retrieved without over pulling on the wireline.

SUMMARY OF THE INVENTION

The drilling tool may be installed with a wireline tool under this method by securing the drilling tool to a drill lock assembly. A wireline setting tool is latched to the drill lock assembly, and the combined assemblies are lowered into the profile sub at the lower end of the string of casing. Then, the operator exerts fluid pressure to the interior of the string of casing to actuate the setting tool, which in turn latches the drill lock assembly to the profile sub. The operator then retrieves the setting tool.

Preferably, applying fluid pressure also causes the setting tool to release from the drill lock assembly without the need for pulling upward. The step of setting the drill lock assembly may include stroking a cam member axially from a run-in position to a locked position, which causes the lock member to extend radially outward into engagement with the profile sub. Preferably, a retainer snaps into place once the cam member reaches the locked position, locking the cam member of the drill lock assembly in the locked position.

Preferably, the movement of the cam member to the locked position also releases a latch mechanism between the setting tool and the drill lock assembly. If the cam member fails to move fully to the locked position, the operator may apply fluid pressure again to the interior of the casing and at a level greater than initially to release the latch mechanism between the setting tool and the drill lock assembly.

The wireline setting tool has a setting tool seal that engages the inner diameter surface of the casing as the setting tool is lowered down the casing. Creating a fluid pressure differential across the setting tool seal causes a portion of the setting tool to move downward after the drill lock assembly has landed in the profile sub.

The wireline retrieval tool may also have a seal for engaging the casing. After the retrieval tool lands in engagement with the drill lock assembly, applying fluid pressure to the casing causes the retrieval tool to engage the drill lock assembly. Preferably, the retrieval tool has a grapple on the lower end that engages a profile in the drill lock assembly when the retrieval tool initially lands on the drill lock assembly. Downward movement of the lower body portion of the retrieval tool in response to fluid pressure secures the grapple to the profile so that the assembly may be lifted. The operator pulls upward on the retrieval tool after it is secured to the drill lock assembly to release the drill lock assembly. The upward pulling force may be assisted by hydraulic jars mounted with the retrieval tool. If the drill lock assembly is stuck, the operator may disengage the wireline retrieval tool from the drill lock assembly by again applying fluid pressure against the setting tool seal to move the lower body portion past its lower position, thereby releasing the grapple from the drill lock assembly.

A mechanical retrieval tool having a similar grapple may also be employed with drill pipe. The grapple of the mechanical retrieval tool will engage the drill lock assembly in the same manner as the wireline retrieval tool.

DETAILED DESCRIPTION OF INVENTION

Figure 1A:
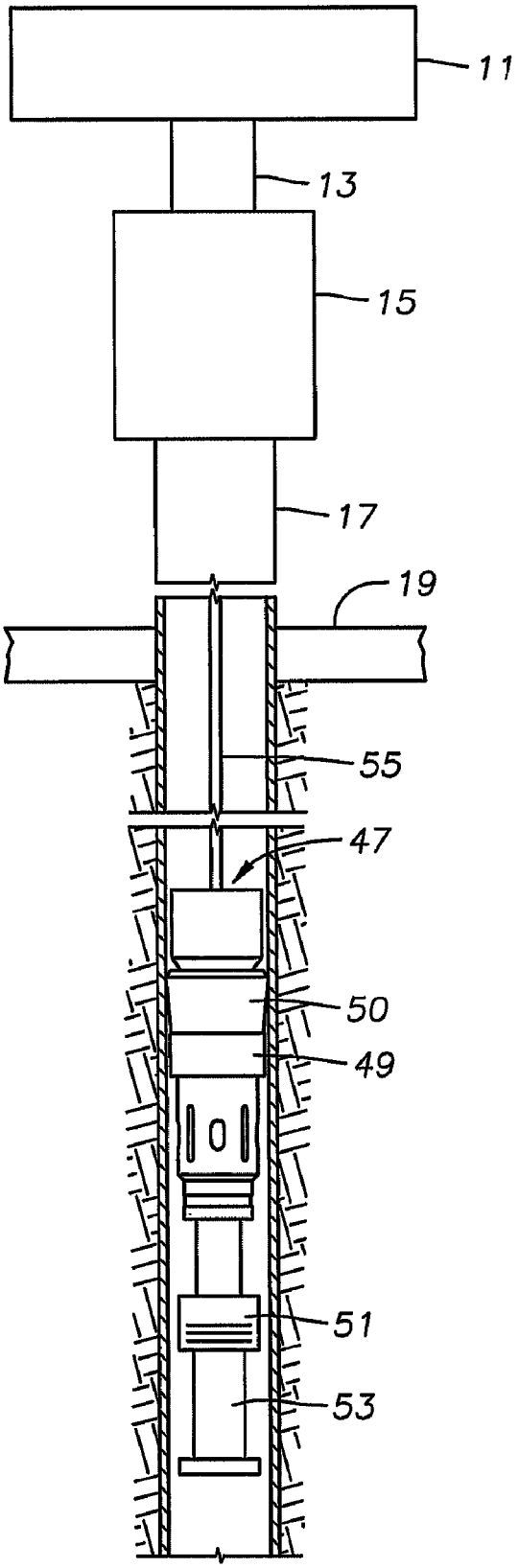
FIGS. 1A and 1B comprise a schematic sectional view illustrating a drill lock assembly attached to a profile sub at the lower end of a string of casing, and a wireline setting tool being retrieved.
Figure 1B:
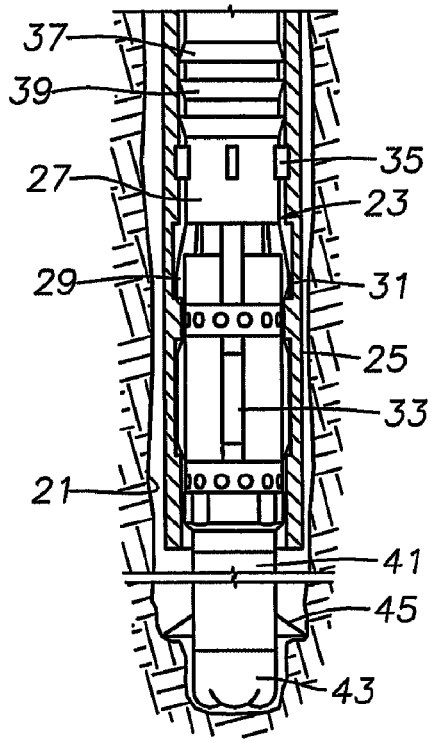

Referring to FIG. 1, a top drive 11 of a drilling rig is schematically shown. Top drive 11 moves upward and downward in a derrick (not shown) and comprises a rotary power source having a quill 13 that rotates. A casing gripper 15 is attached to quill 13 for rotation with it. Casing gripper 15 has gripping members (not shown) that engage either the inner diameter or outer diameter of conventional casing 17. Casing 17 is shown extending from casing gripper 15 through a rig floor 19 into a borehole 21 (FIG. 1B).

As shown in FIG. 1B, a drill lock assembly (DLA) 23 is shown attached to a profile sub 25 located at the lower end of casing 17. DLA 23 has a tubular housing 27. Spring-biased stop dogs 29 extend out from housing 27 and land on an upward-facing shoulder 31 formed in profile sub 25. DLA 23 also has a set of torque keys 33 for transmitting torque between profile sub 25 and DLA 23. Torque keys 33 are also biased outward by springs in this embodiment and engage mating longitudinal slots in profile sub 25. In this embodiment, DLA 23 also has a set of axial lock members 35. Lock members 35 engage mating recesses in profile sub 25 to prevent upward movement of DLA 23 relative to profile sub 25.

DLA 23 has an upper seal 37 on its exterior arranged for preventing the upward flow of fluid from below. In this example, upper seal 37 is a downward facing cup seal. DLA 23 also has one or more lower seals 39 (two shown) for preventing drilling fluid pumped down from above from flowing around the exterior of DLA 23. In this example, lower seals 39 are also cup seals but face upward rather than downward. Seals other than cup seals may be employed for seals 37, 39.

A drilling assembly 41 attaches to the lower end of DLA 23 and extends downward past casing 17. A drill bit 43 forms a part of drilling assembly 41 and it typically has a reamer 45 for enlarging the wellbore 21. Drilling assembly 41 may have other tools, such as measuring instruments and directional drilling steering tools. The bottom hole assembly comprising DLA 23 and drilling assembly 41 are retrievable from casing 17.

DLA 23 may be secured to profile sub 25 and lowered into borehole 21 with casing 17. For repair or replacing components of the bottom hole assembly, including drill bit 43 or any measuring or steering tools incorporated with drilling assembly 41, the operator may retrieve DLA 23 on wireline and re-install it on wireline. FIG. 1A shows DLA 23 after it has been installed by a wireline setting tool 47, which is shown released from DLA 23 and being pulled back to the surface. Setting tool 47 has an upper body assembly with a seal 50 that enables fluid pressure in casing 17 to be exerted on setting tool 47 for actuating it. Pumping may also be employed, if desired, to convey setting tool 47 to the bottom of casing 17, or the downward movement could be due only to gravity. Setting tool 47 has a latch member 51 that releasably latches to DLA 23. Setting tool 47 has a latch mandrel extension 53 that extends downward from latch member 51 for actuating axial lock members 35 (FIG. 1B).

Referring to FIGS. 2A-2D and FIGS. 3A-3D, setting tool 47 may optionally have as part of its upper body assembly a poppet valve 49 having a valve stem 57. Valve stem 57 is an axially extending rod that has an upper threaded end 59 for connecting to the lower end of wireline 55 (FIG. 1A). A poppet valve element 61 comprising an enlarged flange is located at the lower end of poppet valve stem 57. A restrictive flow area passage 63 leads from the sidewall of poppet valve element 61 to the lower end of poppet valve element 61. Poppet valve stem 57 is carried within a poppet valve housing 65 that has a plurality of upper bypass ports 67 in its sidewall. A coil spring 69 encircles valve stem 57 and is compressed between poppet valve element 61 and the upper end of poppet valve housing 65. Coil spring 69 will normally be in the contracted position of FIG. 3A while the assembly is being lowered into the well due to the weight of the bottom hole assembly. Coil spring 69 moves to the extended position of FIG. 2A after DLA 23 (FIG. 1B) lands in profile sub 25.

Figure 2A:
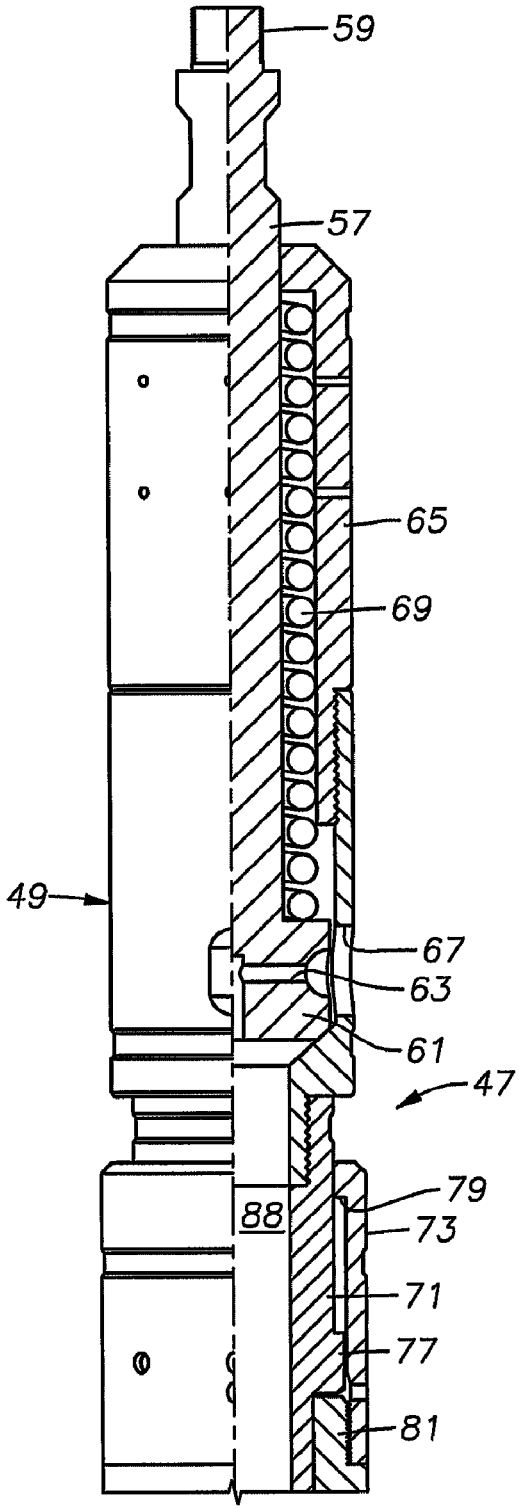
FIGS. 2A-2D comprise a sectional view of the setting tool and drill lock assembly of FIGS. 1A and 1B, prior to setting.
Figure 3A:
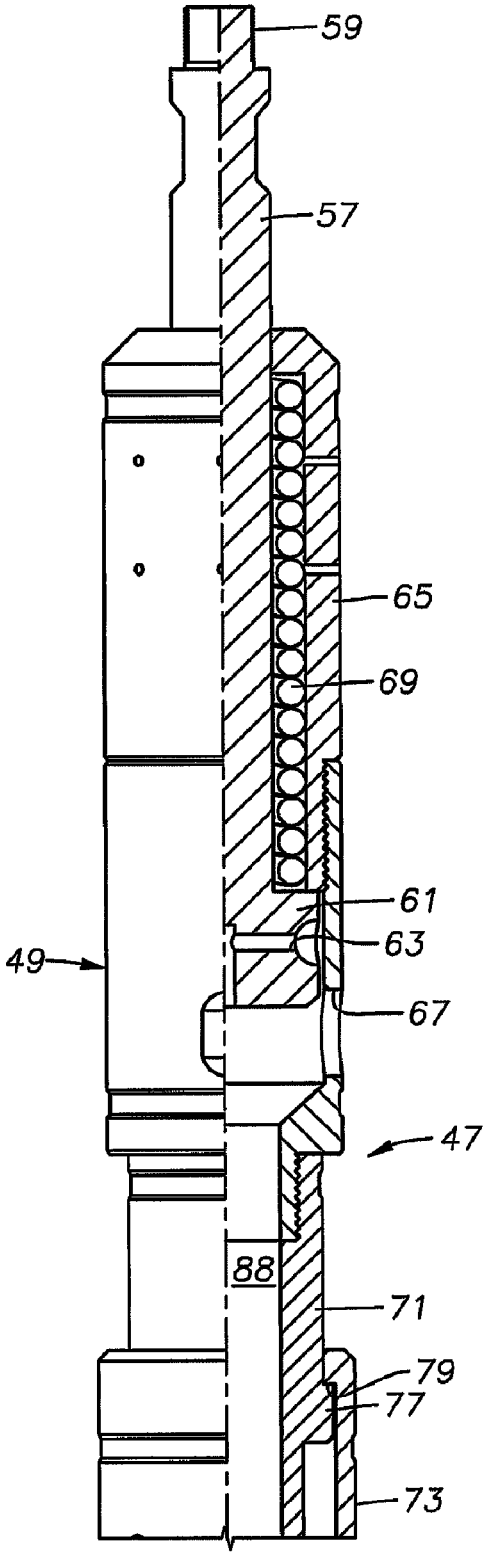
FIGS. 3A-3D comprise a sectional view similar FIGS. 2A-2D, but showing a subsequent step wherein an upper portion of the setting tool has moved downward relative to the lower portion of the setting tool to set the drill lock assembly.

Referring still to FIGS. 2A and 3A, a valve sleeve 71 is secured by threads to the lower end of poppet valve housing 65. An outer sleeve 73 is mounted around valve sleeve 71. A valve sleeve band 77 on valve sleeve 61 is in sliding engagement with the inner diameter of outer sleeve 73. Outer sleeve 73 has a shoulder 79 that faces downward and is spaced above band 77 while spring 69 is in the extended position. When compressed, as shown in FIG. 3A, outer sleeve 73 moves downward relative to valve sleeve 71, and shoulder 79 contacts band 77.

Figure 2B:
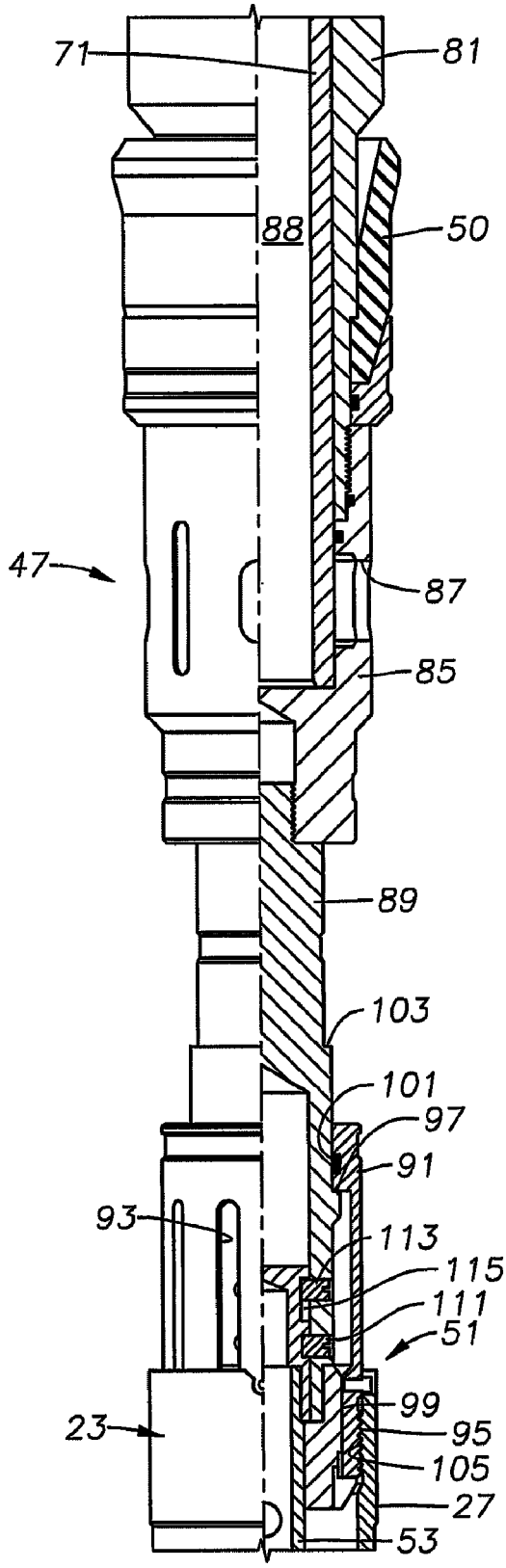
Figure 3B:
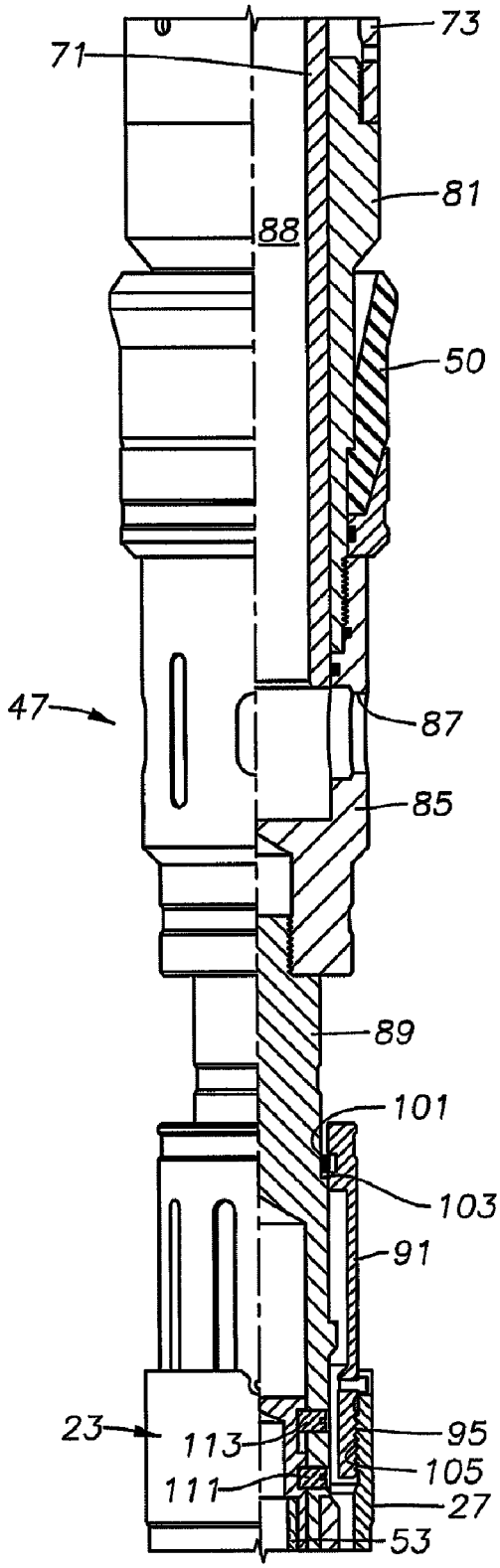

As shown in FIGS. 2A and 2B, a seal support 81 is secured by threads to outer sleeve 73. An upward facing seal 50 is mounted to seal support 81, seal 50 being a cup seal in this embodiment. A lower bypass port housing 85 is secured by threads to seal support 81. Lower bypass port housing 85 has a plurality of lower bypass ports 87. While in the closed position in FIG. 2B, valve sleeve 71 blocks flow into or out of lower bypass ports 87. When outer sleeve 73 (FIG. 3A) moves downward relative to valve sleeve 71, it moves lower bypass ports 87 to an open position as shown in FIG. 3B. When lower bypass ports 87 are open, a bypass passage 88 through the interior of valve sleeve 71 is open. Upper bypass ports 67 are always open, but when poppet valve element 61 is in the lower position of FIG. 2A, the flow through bypass passage 88 is restricted because passage 63 has a lesser flow area than the cumulative flow area of upper bypass ports 67.

The purpose of poppet valve 49 is to enable tools to be pumped downwards in non-vertical wells, typically those that have near horizontal sections. When the well has limited deviation, the tools will be pulled in by gravity and spring 69 of the poppet valve is compressed. A bypass conduit is open through lower bypass port 87 since valve sleeve 71 remains in its uppermost position due to gravity pulling the tools attached to sleeve 73 downward. In marginal scenarios, spring 69 may be compressed, partially compressed or at its installed length, thus bypass port 67 may not be open.

If bypass port 67 is closed, which happens when gravity is unable to pull tools into the well and wireline 55 (FIG. 1A) is slacked off, then regardless of the position of valve sleeve 71, pumping down casing 17 will create a pressure drop from flow going through restriction 63. The pressure drop will act on seal 50 (FIG. 2B), thus pushing valve sleeve 71 downward and closing lower bypass port 87. Now, applied fluid pressure in casing 17 from above will act across seal 50 and allow pumping in of the tools.

Referring to FIG. 2B, a latch mandrel 89 is secured to lower bypass housing 85 and extends downward. Latch member 51 of setting tool 47 is mounted to latch mandrel 89 for releasable engagement with DLA 23. Latch member 51 includes in this example a collet latch 91, which comprises a sleeve having longitudinal slots 93 so as to define radially flexible collet fingers or gripping members 95, each of which has grooves on its outer side. The grooves may comprise a thread. Collet latch 91 is mounted around a lower portion of latch mandrel 89. Latch mandrel 89 has a collet support shoulder 97 and a base 99. While in the position of FIG. 2B, base 99 is located within gripping members 95, preventing them from deflecting inward. Collet latch 91 has a detent or snap ring 101 in its upper end, which is located above collet support shoulder 97.

Latch mandrel 89 moves downward relative to collet latch 91 when fluid pressure in casing 17 (FIG. 1) is applied after DLA 23 has landed in profile sub 25 (FIG. 1B). FIG. 3B shows the downward movement of latch mandrel 89, which places shoulder 97 in a lower position and snap ring 101 in engagement with a snap ring shoulder 103. When in the lower position of FIG. 3B, latch mandrel base 99 will be spaced below gripping members 95 rather than in back up engagement as in FIG. 2B. This lower position allows gripping members 95 to flex inward and release from grooved, preferably threaded, profile 105 in the interior of DLA housing 27. Pulling upward on latch mandrel 89 after it is in the position of FIG. 3B will cause gripping members 95 to move upward from DLA 23.

Referring still to FIG. 2B, latch mandrel extension 53 attaches to latch mandrel 89 within latch mandrel base 99. In this example, this attachment comprises a first set of fixed shear pins 111 that are located within mating circular holes. A second set of floating shear pins 113 extend between latch mandrel 89 into elongated holes 115. Shear pins 111 and 113 will shear in an emergency in case DLA housing 27 is prevented by some obstacle from moving downward a full stroke when fluid pressure is acting on upper seal 50 (FIG. 2B). Shearing is accomplished by increasing the fluid pressure in casing 17, and once sheared, latch mandrel 89 is free to move downward relative to latch mandrel extension 53 so as to place its base 99 below gripping members 95. This procedure allows gripping members 95 to release from internal threads 105, enabling setting tool 47 to be retrieved while DLA 23 remains in the well. Rather than having two sets of shear pins 111, 113, only a single set may suffice.

Figure 2C:
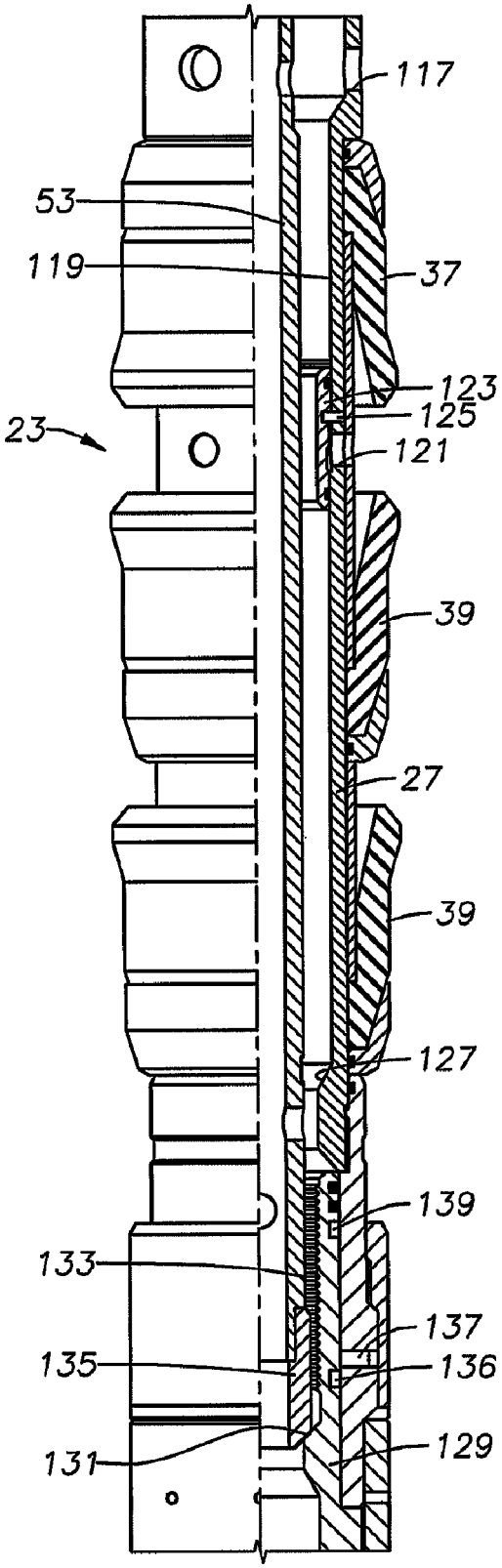
Figure 3C:
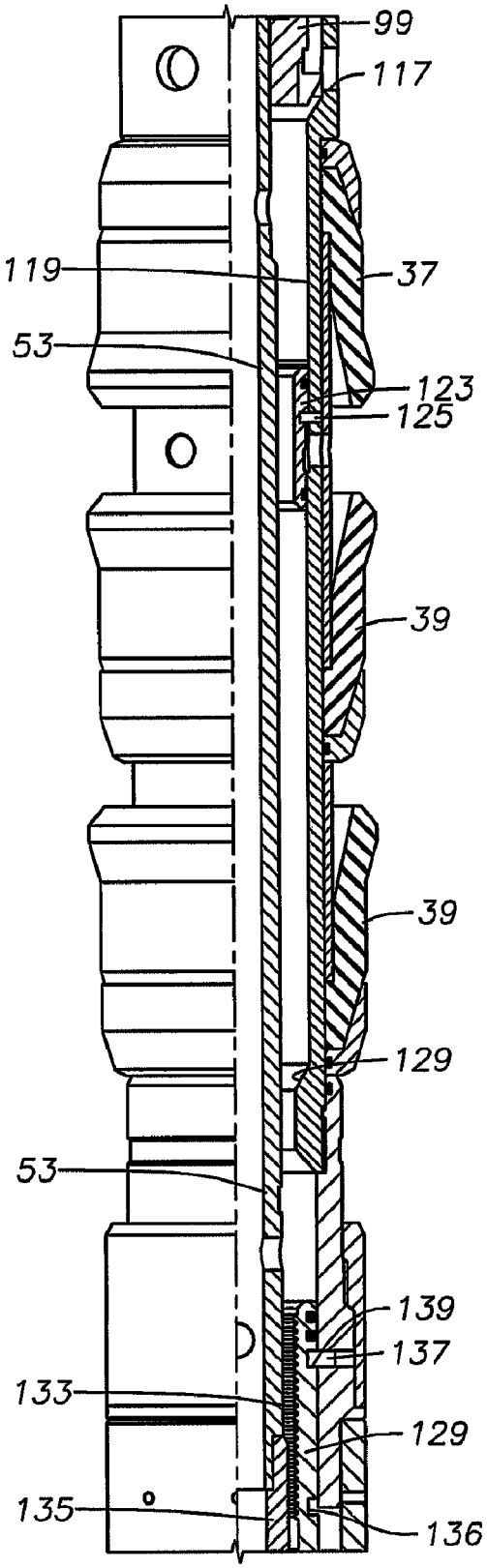

Referring to FIGS. 2C and 3C, DLA 23 has an upper equalization port 117 that extends into bore 119 of DLA housing 27. Upper equalization port 117 is located above DLA seals 37 and 39 and is always open. Another equalization port 121 extends through the sidewall of DLA housing 27 below upper equalization port 117. Equalization port 121 is located between DLA upper seal 37 and DLA lower seals 39. Equalization ports 117, 121 have a closed position, and in this example, closure is handled by an internal sleeve valve 123. Sleeve valve 123 is secured by a shear pin 125 over lower equalization port 121. DLA housing 27 has a internal shoulder 127 that faces upward for retaining sleeve valve 123 after it has been released.

Figure 3D:
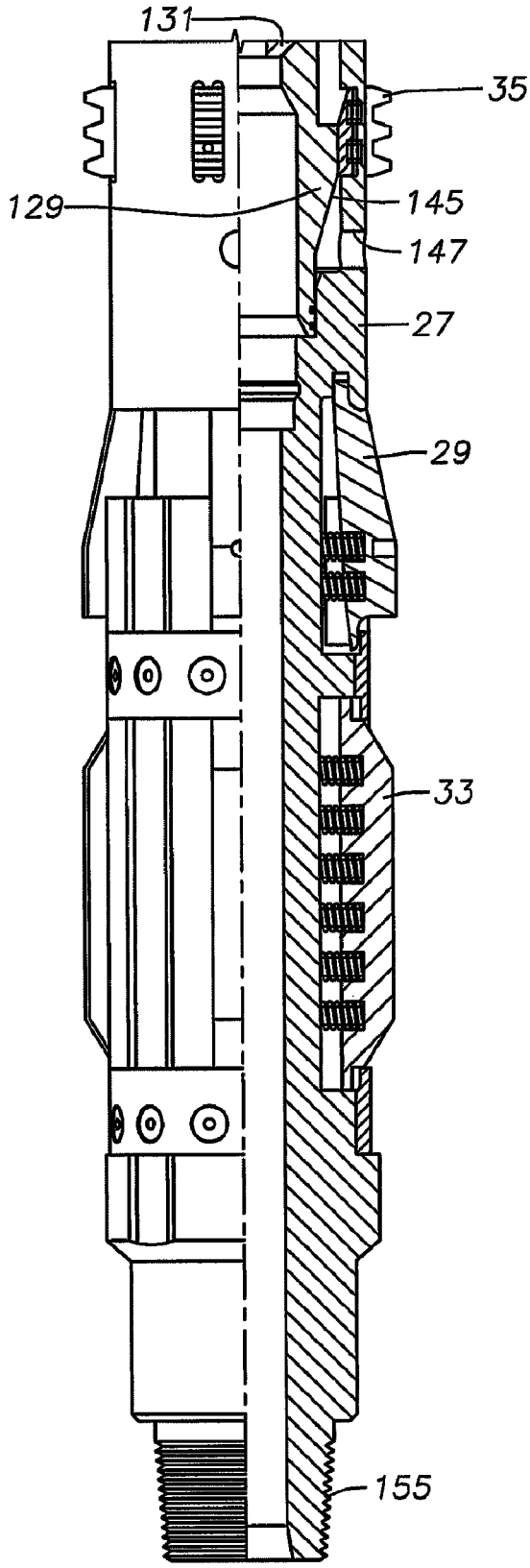

Referring still to FIG. 2C, a cam mandrel 129 is mounted within DLA housing 27 below internal shoulder 127. Cam mandrel 129 has an upward facing internal shoulder 131. Cam mandrel 129 also has an internal profile 133 comprising a set of parallel grooves or threads. Cam mandrel 129 is held in the upper position shown in FIG. 2C by shear pins (not shown) that engage an annular recess 136. Spring-biased shear pins 137 (only one shown) extend from DLA housing 27 inward above recess 136. In the position shown in FIG. 2C, shear pins 137 are biased against an exterior portion of cam member 129, but not located in any grooves or receptacles, so they perform no locking function while cam mandrel 129 is in the upper position. Cam member 129 is movable from the upper or run-in position shown in FIG. 2C to the lower or locked position of FIGS. 3C and D, and when that occurs, a groove 139 will register with shear pins 137. The springs of shear pins 137 will urge them into groove 139 to hold cam mandrel 129 in the lower position, which is shown in FIGS. 3C and 3D.

Figure 2D:
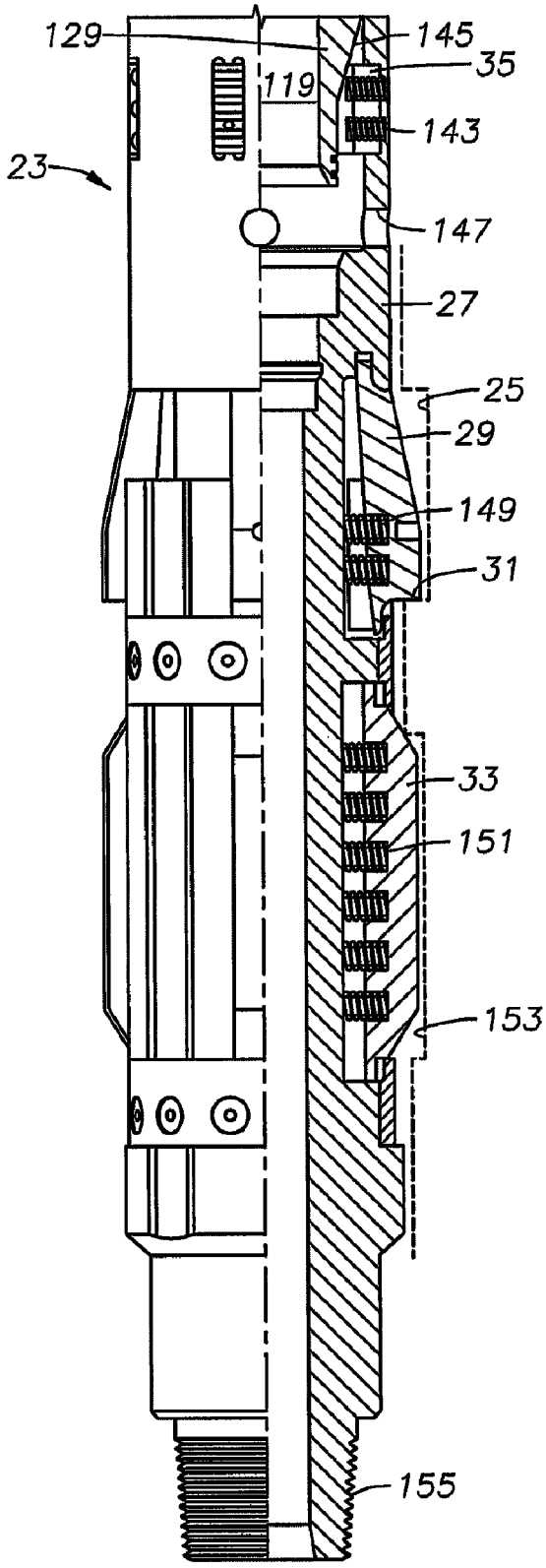

Referring still to FIG. 3C, latch mandrel 53 has a lower end 135 that will contact internal shoulder 131 of cam mandrel 129 and apply a downward force to push it downward. Referring to FIGS. 2D and 3D, cam mandrel 129 has a cam surface 145 that slides against lock dogs 35 to move them radially outward when cam mandrel 129 moves downward, as shown in FIG. 3D. Springs 143 urge lock dogs 35 radially inward.

FIG. 2D shows a lower equalization port 147 that communicates with bore 119, upper equalization port 117 and equalization port 121 (FIG. 2C). Lower equalization port 147 is below DLA seals 39, and in this example below lock dogs 35. Lower equalization port 147 is closed when cam mandrel 129 is in the lower or locked position and open when cam mandrel 129 is in the upper or run-in position.

As shown in FIG. 2D, stop dogs 29 are pivotally mounted to DLA housing 27 at their upper ends. Springs 149 urge the lower ends outward. Torque keys 33 are mounted below stop dogs 29 for radial movement in this embodiment. Torque key springs 151 urge torque key 33 radially outward. DLA housing 27 has a threaded lower end 155 for attachment to drilling assembly 41. (FIG. 1B).

In the setting operation of the embodiment of FIGS. 2-4, latch member 51 (FIG. 2B) of setting tool 47 is attached to DLA housing 27 by rotating setting tool 47 so that gripping members 95 thread into threads 105. Latch mandrel 89 will be in the upper position with its base 99 providing a backup for the gripping members 95 of collet latch 91. Sleeve valve 123 in FIG. 2C will be closed, blocking equalization ports 121. Cam mandrel 129 will be in an upper position with lock dogs 35 retracted as shown in FIG. 2D. The operator attaches DLA 23 to bottom hole assembly 41 and attaches wireline 55 (FIG. 1A) to upper end 59 of valve stem 57. Wireline 55 (FIG. 1A) will pass through conventional wireline pressure control equipment (not shown) at the drilling rig.

The entire assembly is lowered into the well. Drilling assembly 41 (FIG. 1B) will pass through profile sub 25 (FIG. 1B) and stop dogs 29 will land on shoulders 31. FIGS. 2A-D illustrate setting tool 47 and DLA 23 while in this position. After landing, the operator slacks off on wireline 55 and applies fluid pressure to casing 17. Poppet valve 49 will be in the closed position because of the slacking off of wireline 55. If not in a highly deviated portion of a well, bypass port 87 will also be closed. If in a highly deviated portion of a well, flow through restrictive passage 63 in poppet valve 49 will create a pressure drop that will push lower bypass port 87 closed. The fluid pressure to the interior of casing 17 acts on upper seal 50 (FIG. 2B) to causes latch mandrel 89 to move downward from the position shown in FIG. 2B to the position shown in FIG. 3B. This movement is sufficient to cause latch mandrel extension 53 to shear the shear pins holding cam mandrel 129 in the upper position. Cam mandrel 129 moves from the upper position in FIG. 2C to the lower position in FIG. 3C. As shown in FIG. 3D, lock dogs 35 are pushed outward into locking engagement with a profile in profile sub 25 (FIG. 1B). This movement also causes spring-biased shear pins 137 to align and snap into groove 139 as shown in FIG. 3C, locking cam mandrel 129 in the lower position.

Figure 4A:
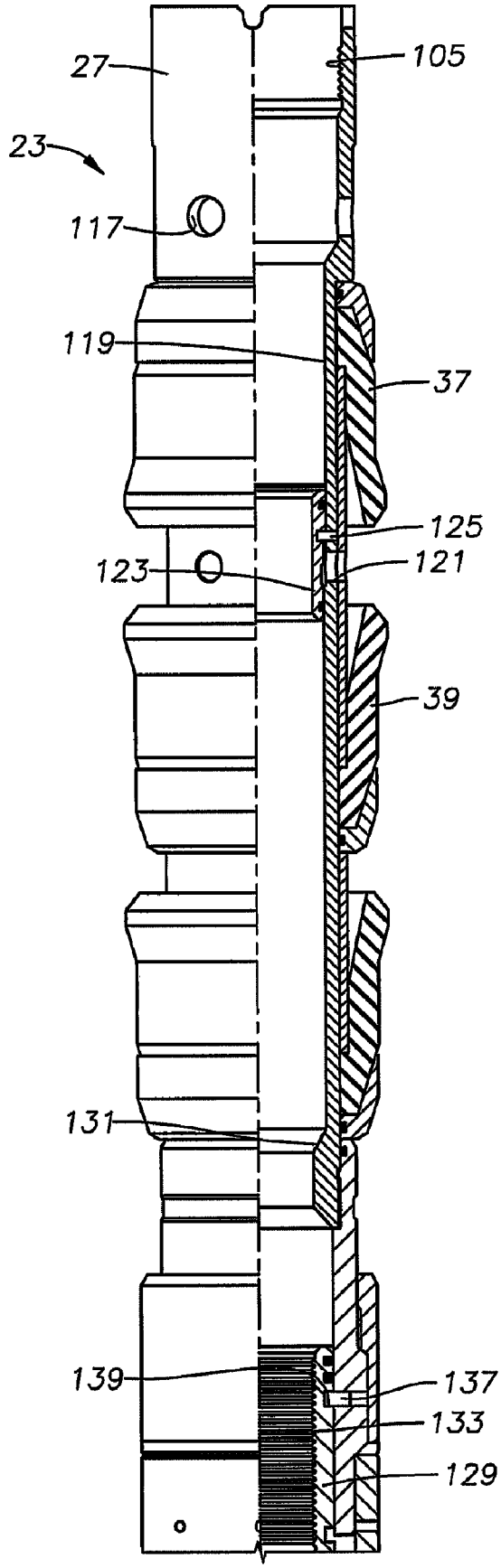
FIGS. 4A and 4B comprise a vertical sectional view of the drill lock assembly as shown in FIGS. 3A-3D, but with the setting tool removed.
Figure 4B:
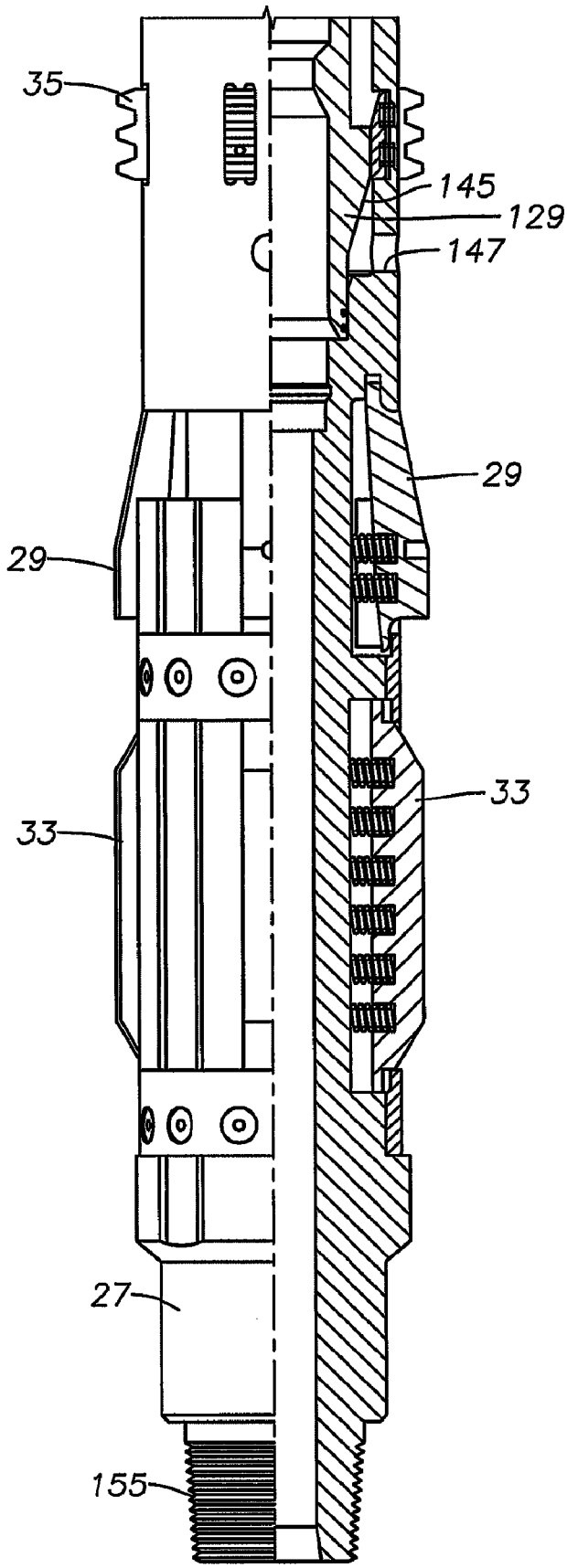

In addition, the downward movement of latch mandrel 89 also causes latch 91 to release as can be seen by comparing FIGS. 2B and 3B. Latch mandrel base 99 moves below collet gripping members 95, enabling them to flex back radially inward slightly. Snap ring 101 engages shoulder 103. After being released, upward movement of wireline 55 (FIG. 1A) pulls upward on valve stem 57, as shown in FIG. 3A, which in turn pulls upward on latch mandrel 89 (FIG. 3B). Latch mandrel 89 is free to move upward because collet 91 will also move upward with it. Enlarged base 99 thus can not move upward into backup engagement with collet gripping members 95. As the operator pulls setting tool 47 above drill lock assembly 23, drill lock assembly 23 will appear as shown in FIGS. 4A and 4B. Cam mandrel 129 will be locked in its lower position. Valve sleeve 123 will still be in its closed position. Spring-biased shear pins 137 will be retaining cam mandrel 129 in the lower position.

In the event wireline setting tool 47 does not release from DLA 23, it may be due to improper setting. That is, latch mandrel extension 53 may not have stroked downward the full stroke for setting cam mandrel 129. In that event, setting tool 47 can be released from DLA 23 by applying fluid pressure again to casing 17, but at a level sufficient to push latch mandrel 89 downward relative to latch mandrel extension 53 to break shear pins 111 and 113 (FIG. 2B). This level is greater than the fluid pressure required to shear the shear pins holding cam mandrel 129 in the upper position. Once shear pins 111, 113 have sheared, latch mandrel base 99 will move below collet gripping members 95, enabling setting tool 47 to be retrieved while leaving DLA 23 in casing 17. Shoulder 97 will retain latch mandrel extension 53 with latch mandrel 89. An inspection by an operator at the surface will show that shear pins 111 and 113 have sheared, informing the operator that DLA 23 is not likely to have been set properly. The operator may then return with a retrieval tool to retrieve DLA 23.

Figure 5A:
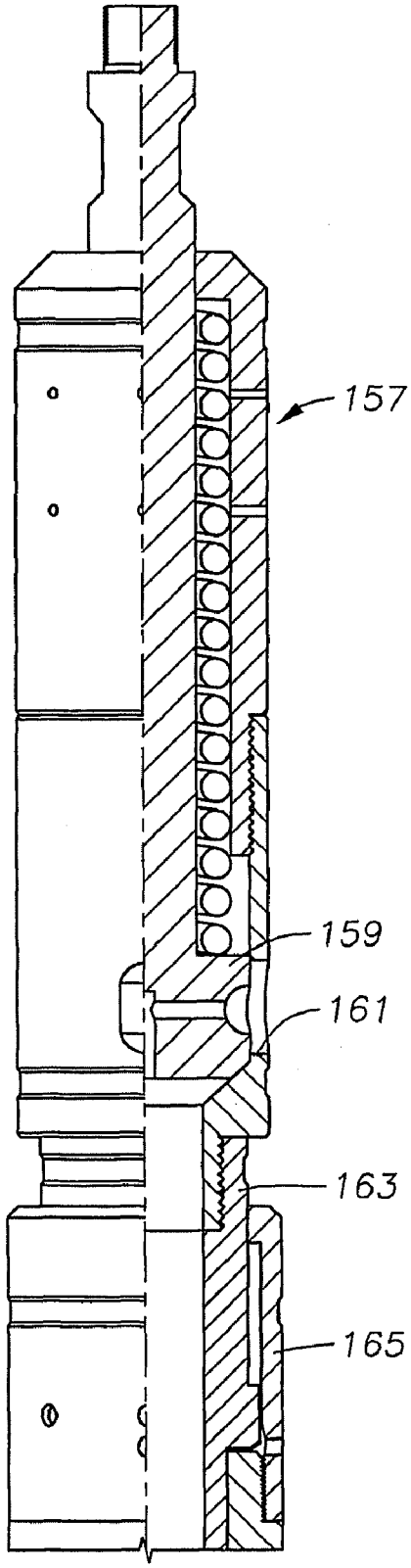
FIGS. 5A-5D illustrate a retrieval tool in initial engagement with the drill lock assembly of FIGS. 4A and 4B and prior to retrieving.
Figure 5B:
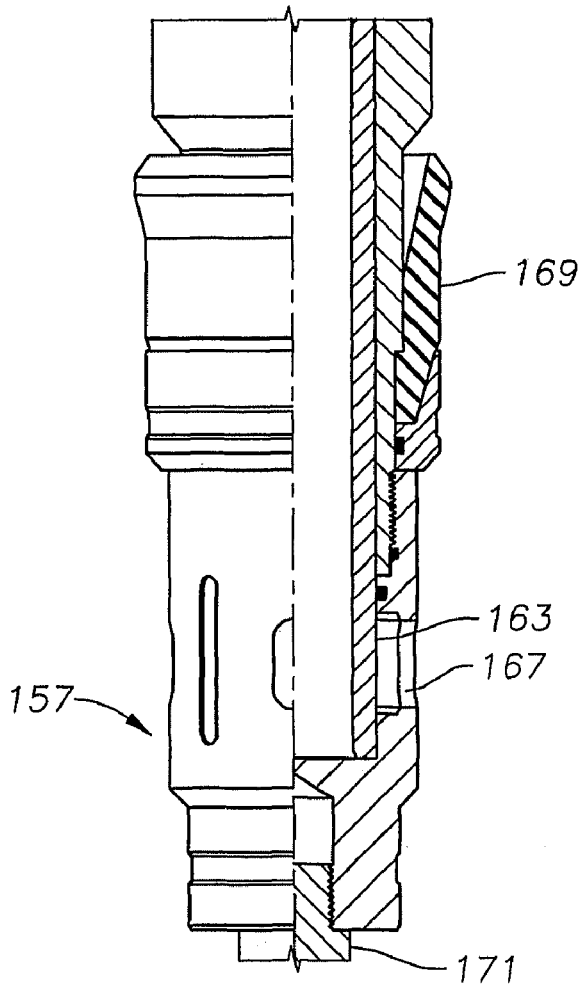
Figure 5C:
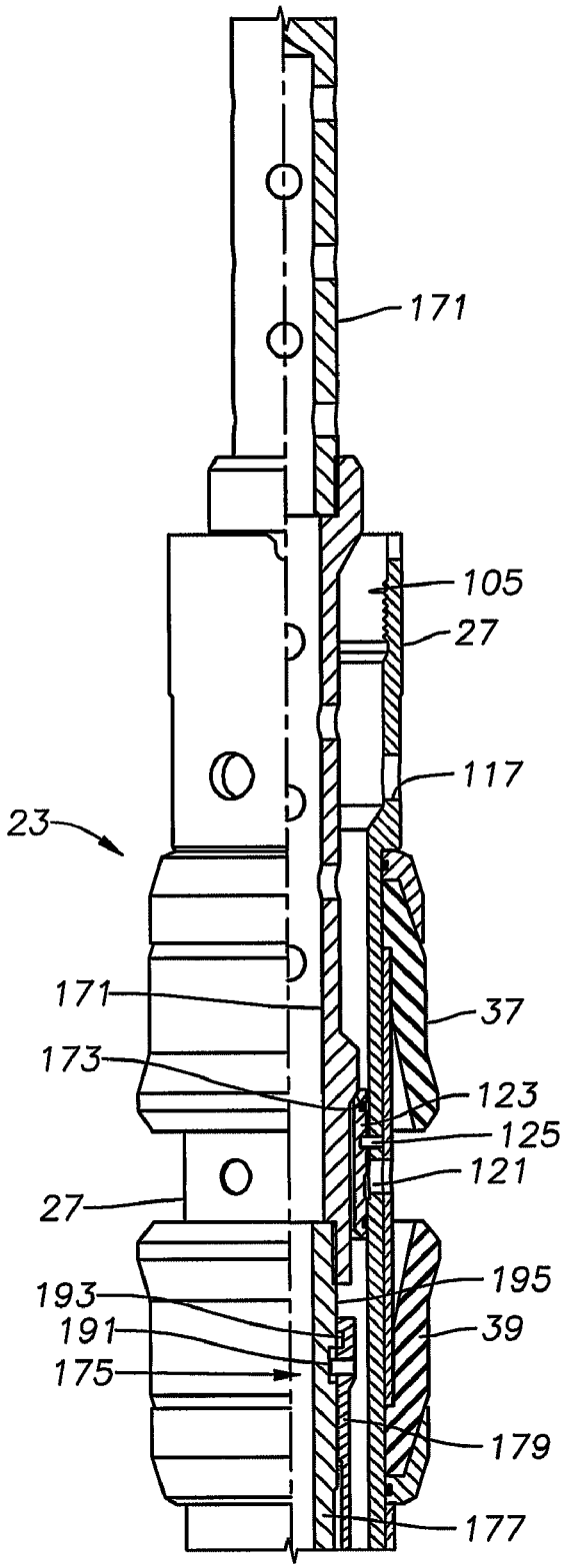
Figure 5D:
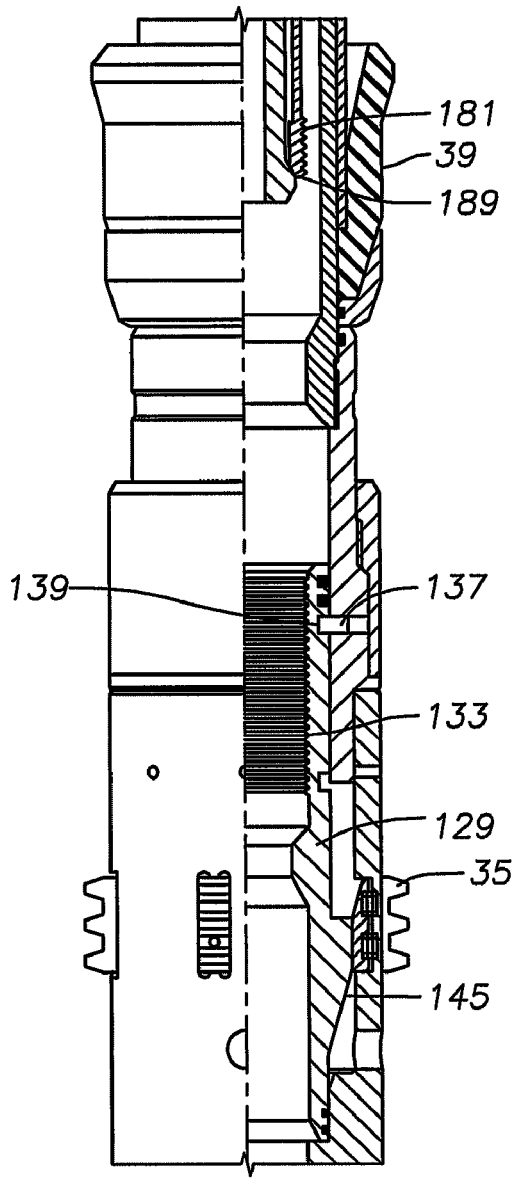

When retrieval of drilling assembly 41 (FIG. 1B) is desired, in this example, the operator lowers on wireline 55 a retrieval tool 157, shown in FIGS. 5A-5C. Retrieval tool 157 has an upper body portion that may be the same as the upper body portion of setting tool 47 (FIG. 1A). The common features may include a poppet valve assembly that has the same components, such as poppet valve element 159 and upper bypass port 161. The upper body portion may also include a valve sleeve 163 and an outer sleeve 165 in the same manner as setting tool 47. As shown in FIG. 5B, retrieval tool 157 may also have an upward facing seal 169 and a lower bypass port 167. These components all work in the same manner as with setting tool 47 and will not be discussed in the same detail. In fact, an operator may use these components both for setting and retrieving, and convert the setting tool to the retrieval tool by removing latch mandrel 89 (FIG. 2B) and attaching a lower body portion 171.

Lower body portion 171 is a tubular assembly that extends downward into DLA 23 when retrieval tool 157 lands. As shown in FIG. 5C, lower body portion 171 has a downward facing shoulder 173 configured to land on sleeve valve 123. A grapple 175 is attached to the lower end of lower body portion 171. Grapple 175 includes an inner tubular collet support 177 about which a cylindrical collet 179 is mounted. Collet 179 has gripping members 181 formed by longitudinal slots extending from the lower end of collet 179. Collet support 177 has a support shoulder 189 on its lower end that contacts the lower end of collet 179. Collet 179 is attached to collet support member 177 by shear pins 191 that engage elongated slots. Collet 179 preferably has a snap ring 193 located above shear pins 191. Snap ring 193 is designed to engage a snap ring receptacle 195 if shear pins 191 shear.

Figure 6A:
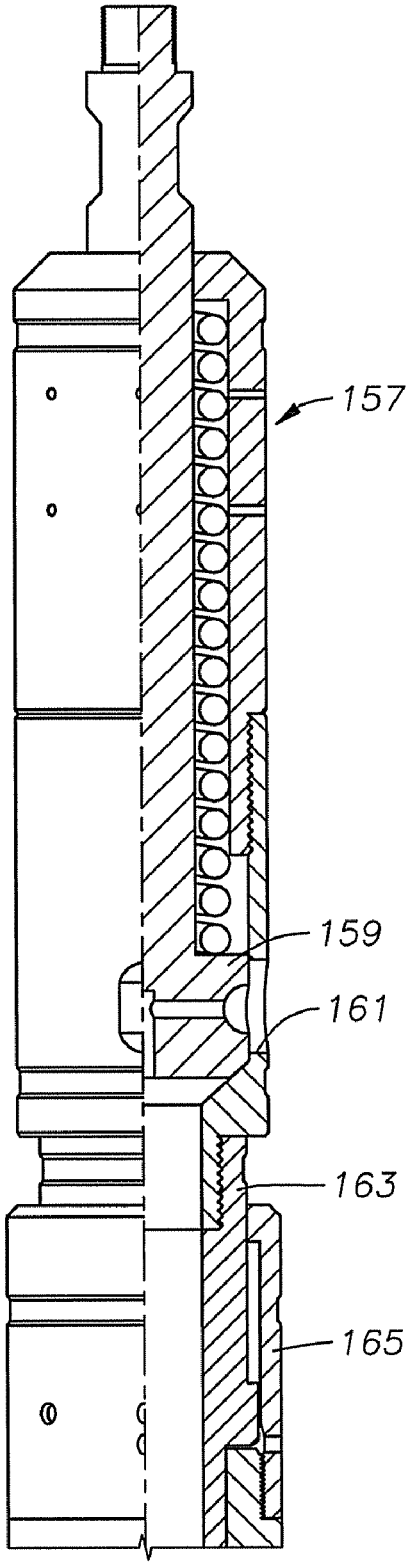
FIGS. 6A-6C is a sectional view of the retrieval tool of FIGS. 5A-5D but showing the retrieval tool in a subsequent step of retrieving the drill lock assembly.
Figure 6B:
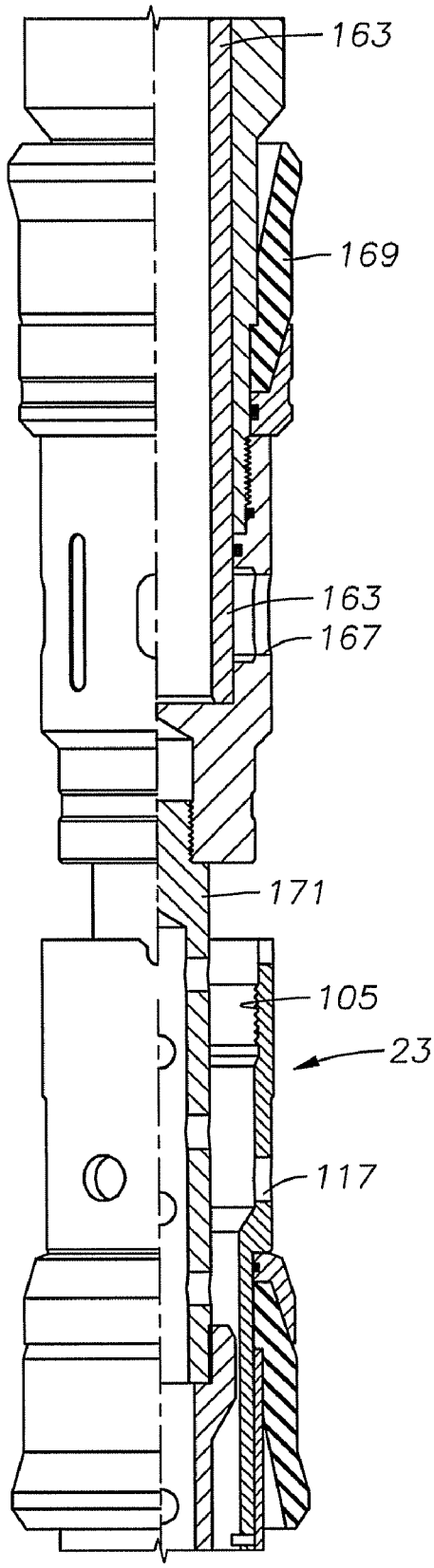
Figure 6C:
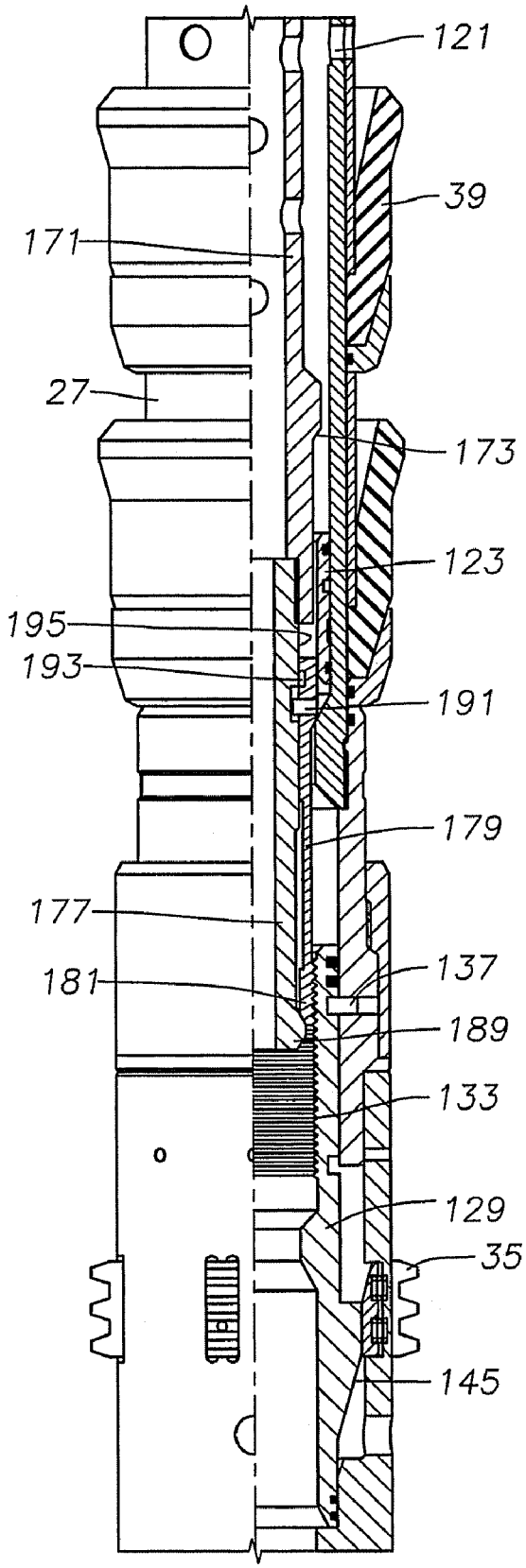

In the operation of retrieval tool 157, the operator attaches it to wireline 55 (FIG. 1A) and lowers it into DLA 23 until shoulder 173 contacts sleeve valve 123 as shown in FIG. 5C. If desired, the operator may assist the downward movement of retrieval tool 157 by pumping fluid down the casing. After contacting sleeve valve 123, applying fluid pressure from the interior of casing 17 to retrieval tool seal 169 (FIG. 5B), shears shear pins 125 (FIG. 5C), causing retrieval tool 157 to move downward to the position shown in FIGS. 6B and 6C. Equalization ports 121 open and retrieval tool 157 moves downward to the position of FIG. 7B. The downward movement places grapple 175 into engagement with threads 133 within cam mandrel 129 as shown in FIG. 7C.

Figure 7A:
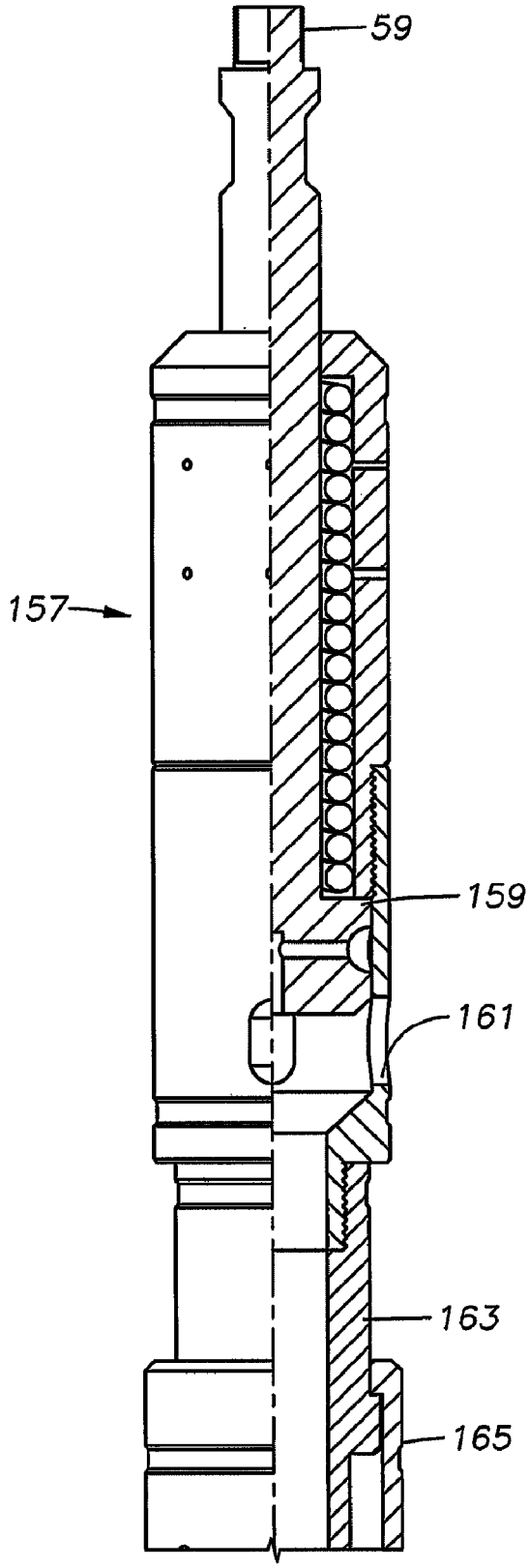
FIGS. 7A-7D comprise a sectional view of the retrieval tool and drill lock assembly of FIGS. 5A-5C showing a further step of retrieval.
Figure 7B:
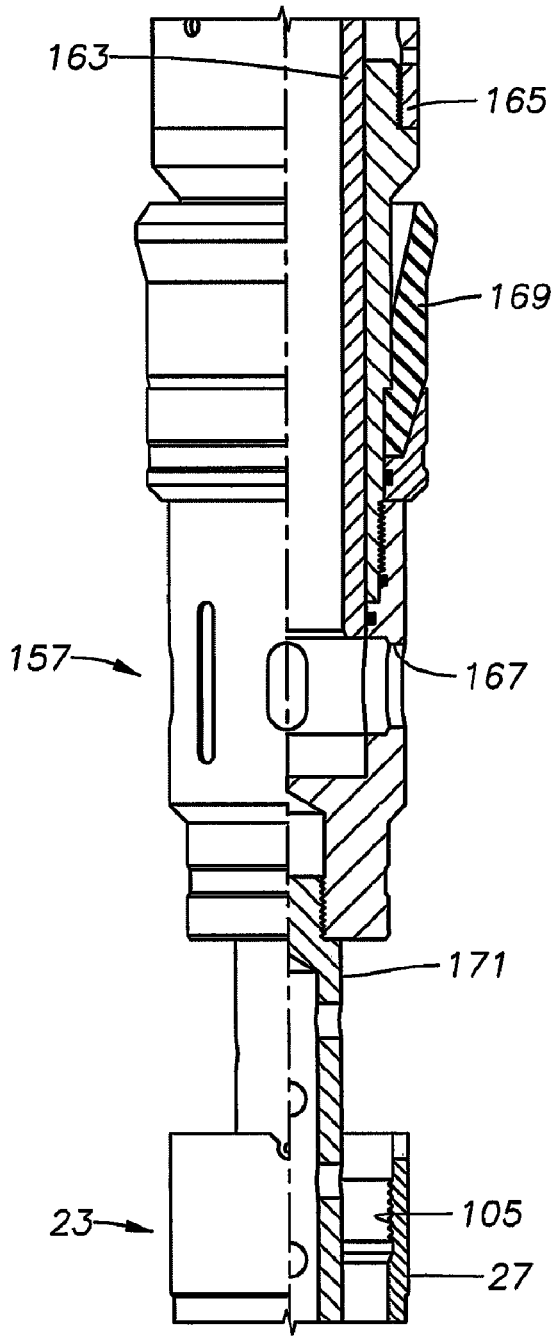
Figure 7C:
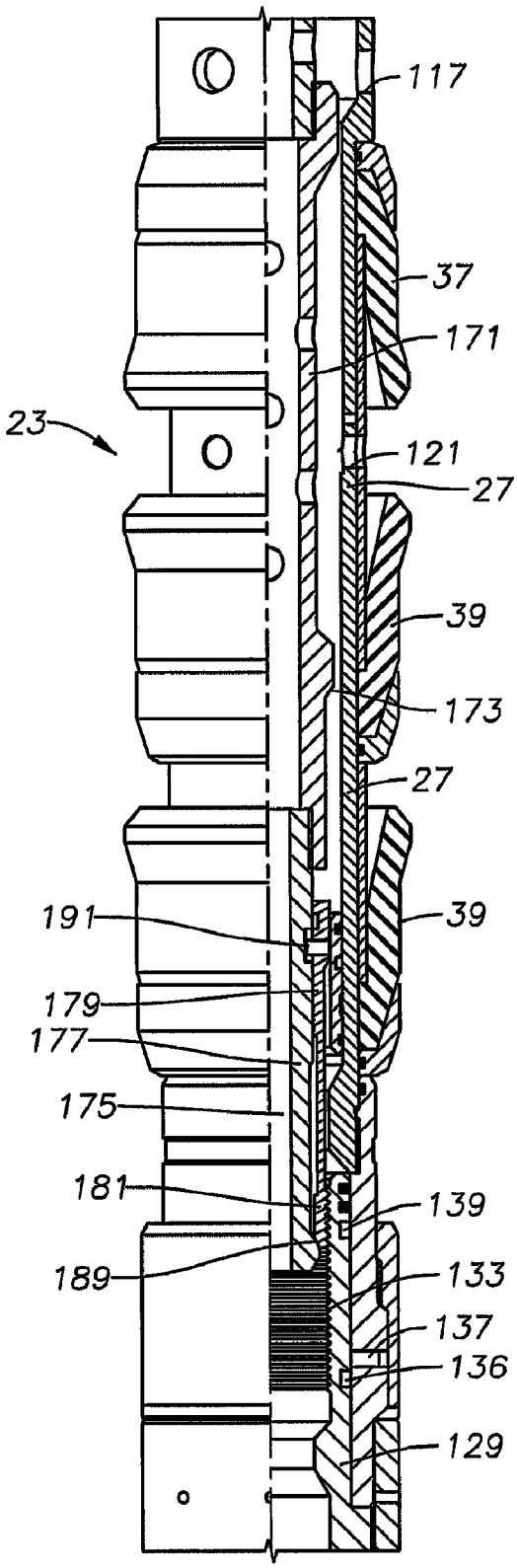
Figure 7D:
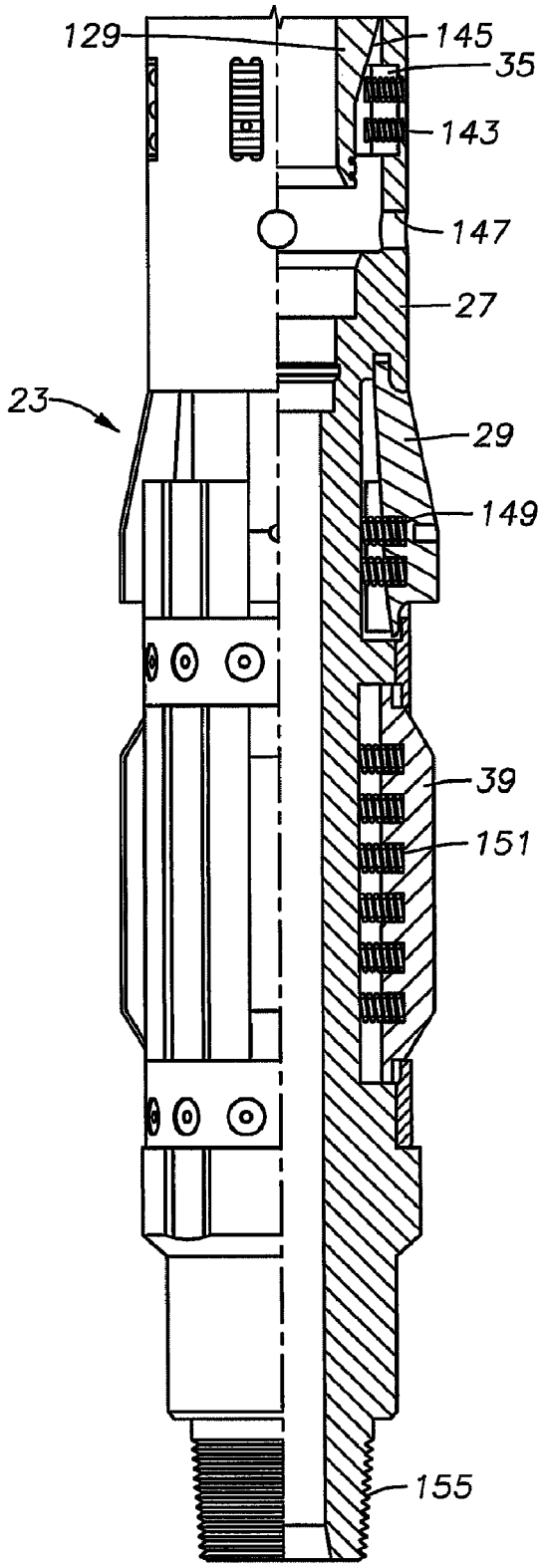

The operator then pulls upward on wireline 55 (FIG. 1A), which pulls cam mandrel 129 to the upper position shown in FIG. 7C. Grapple shoulder 189 moves upward slightly relative to gripping members 181 and exerts an upward an outward force on gripping members 181 that transfers to threads 133. Shear pins 137 break from the upward pull or from activating hydraulic jars 197 (FIG. 9) located between lower body portion 171 and lower bypass housing 87. The upward movement of cam mandrel 129 causes lock dogs 35 to retract, freeing the assembly to be pulled to the surface, and opening lower equalization ports 147. As the assembly is pulled to the surface, the fluid in casing 17 (FIG. 1A) bypasses retrieval tool seal 169 (FIG. 7B) by flowing through bypass passage ports 161 (FIG. 5A) and 167 (FIG. 5B). Fluid also bypasses DSA seals 39 (FIG. 7C) via ports 147 in lower body portion 171 to the annulus.

Figure 8:
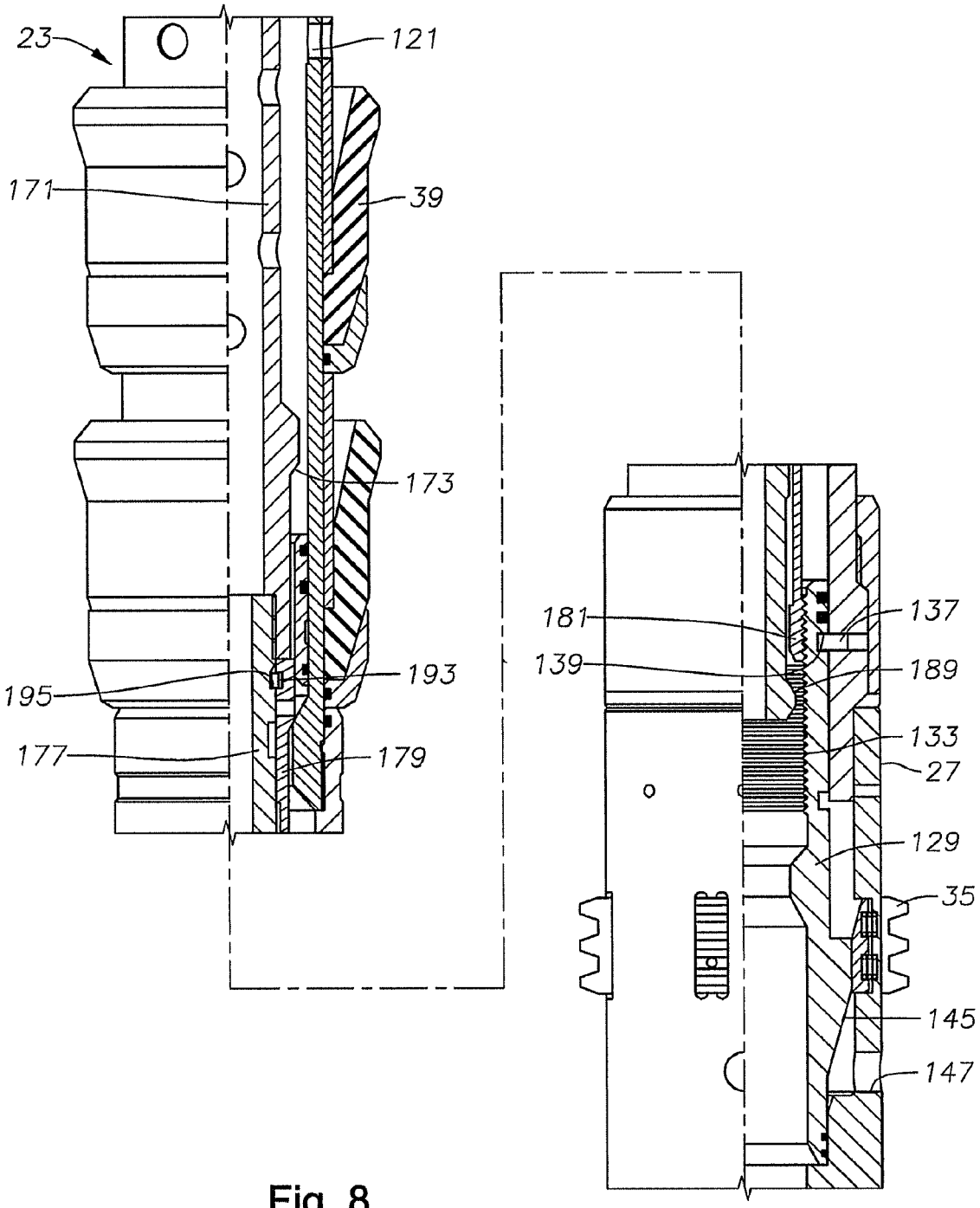
FIG. 8 is a sectional view of the retrieval tool of FIG. 7, showing an emergency release of the retrieval tool from the drill lock assembly taking place.

In the event that DLA 23 is stuck in profile sub 25, which may occur due to accumulation of drilling cuttings, the operator may find that the strength of wireline 55 (FIG. 1A) is inadequate to free DLA 23. If that occurs, the operator can release retrieval tool 157 from cam mandrel 129 by relaxing wireline 55 (FIG. 1A) to allow the poppet spring to close poppet valve element 159 (FIG. 7A). The operator then applies a greater fluid pressure to casing 17 than the pressure used to shear shear pins 125 of sleeve valve 123, This fluid pressure acts on retrieval seal 169 (FIG. 5B) at a pressure sufficient to shear shear pins 191 (FIG. 7C). As shown in FIG. 8, this results in collet support 177 moving downward relative to collet 179 so that shoulder 189 is below gripping members 181. Also, snap ring 193 will now be located above snap ring shoulder 195. Without the backup of shoulder 189, gripping members 189 release from profile 133 allowing the entire retrieval tool 157 to be retrieved to the surface while DLA 23 remains downhole.

Figure 9:
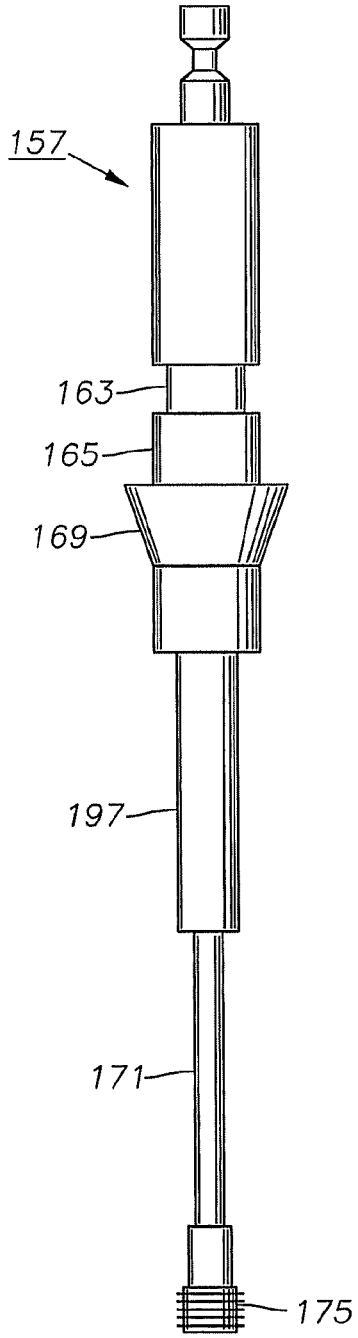
FIG. 9 is a schematic side view of the retrieval tool of FIG. 8, showing a set of jars connected into the retrieval tool.

Then, as shown in FIG. 9, the operator may choose to attach to retrieval tool 157 a set of hydraulic jars 197 by unscrewing lower body portion 171 (FIG. 7B) from the threads at the lower end of the seal support for seal 169. The operator attaches jars 197 to the same threads, which places jars 197 below the poppet valve assembly, outer sleeve 165 and retrieval tool seal 169. Lower body portion 171 would be attached to the lower end of jars 197. Hydraulic jars 197 may be any type of conventional jars that create impacts in response to pulling wireline 55 (FIG. 1A). Jars 197 are re-cocked by slacking off the tension on wireline 55 after the blow is delivered.

The operator may choose to retrieve DLA 23 with a string of drill pipe rather than wireline, whether or not DLA 23 is stuck within profile sub 25. FIGS. 10A-10B and 11A-11C illustrate such a tool. Mechanical retrieval tool 199 has an upper body 201 and a latch mandrel 203. In this example, they are connected by shear pins 205. Latch mandrel 203 has an upper enlarged end that blocks bypass port 206 while in the upper position shown in FIGS. 10A and 11A. Shear pins 205 allows upper body 201 to move upward relative to latch mandrel 203, which places bypass port 206 above the enlarged upper end of latch mandrel 203, opening bypass port 206.

Figure 10A:
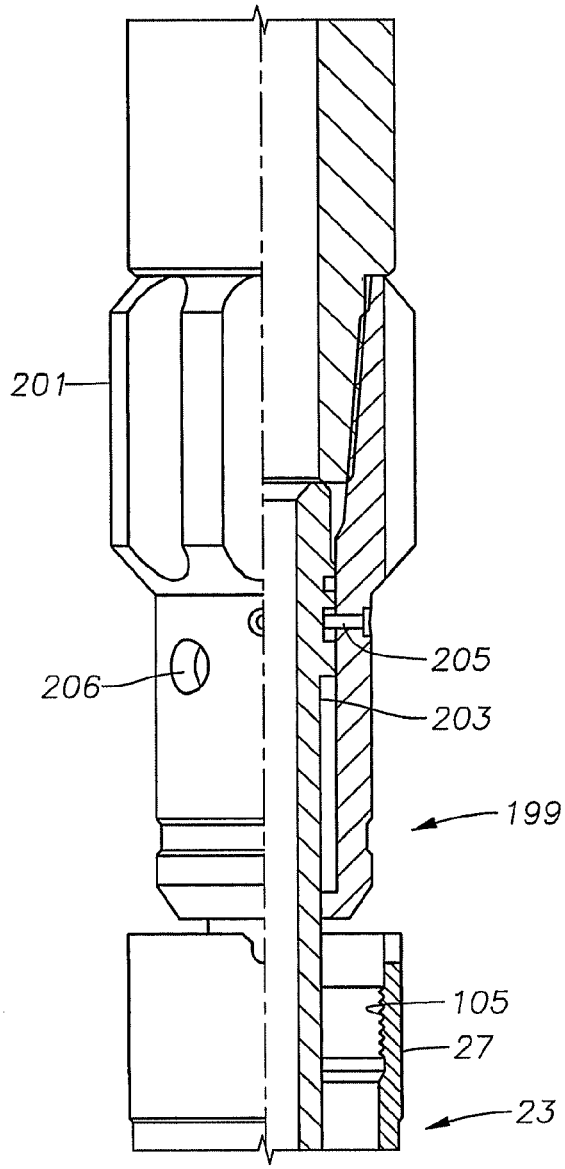
FIGS. 10A-10C comprise a sectional view of a retrieval tool for use with drill pipe.
Figure 10B:
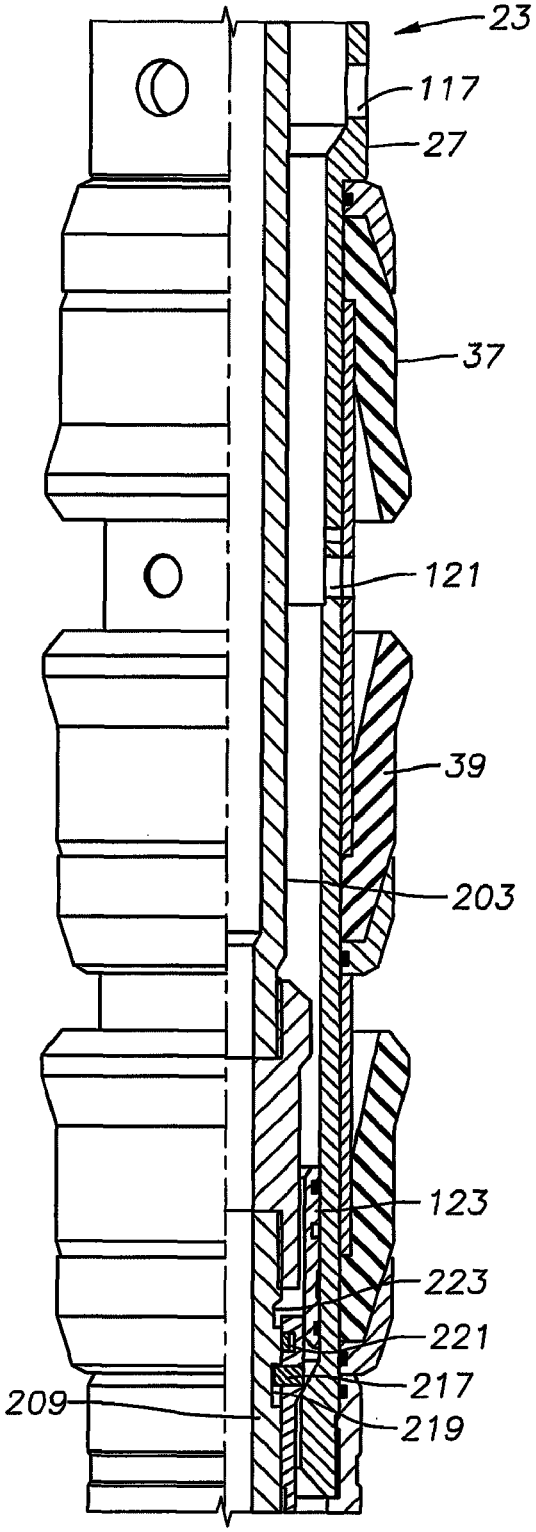
Figure 10C:
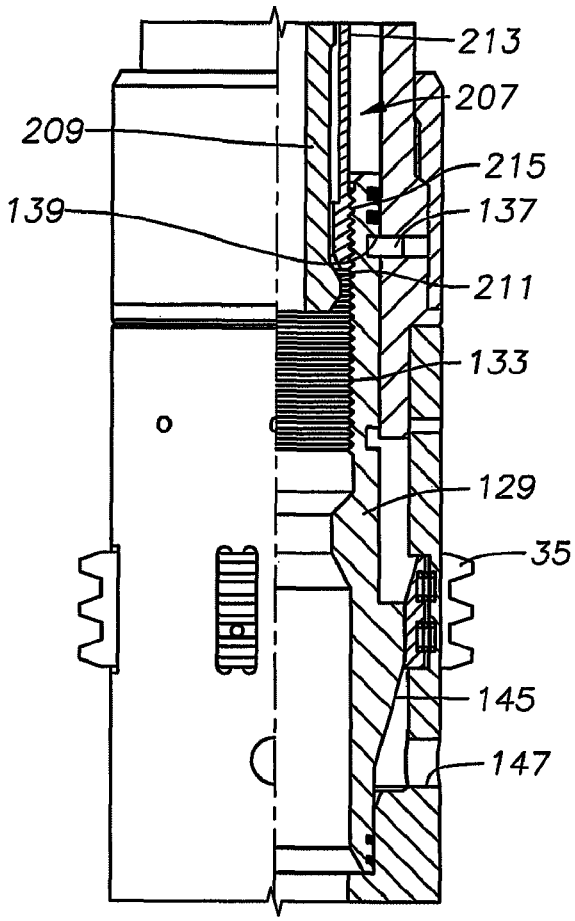
Figure 11A:
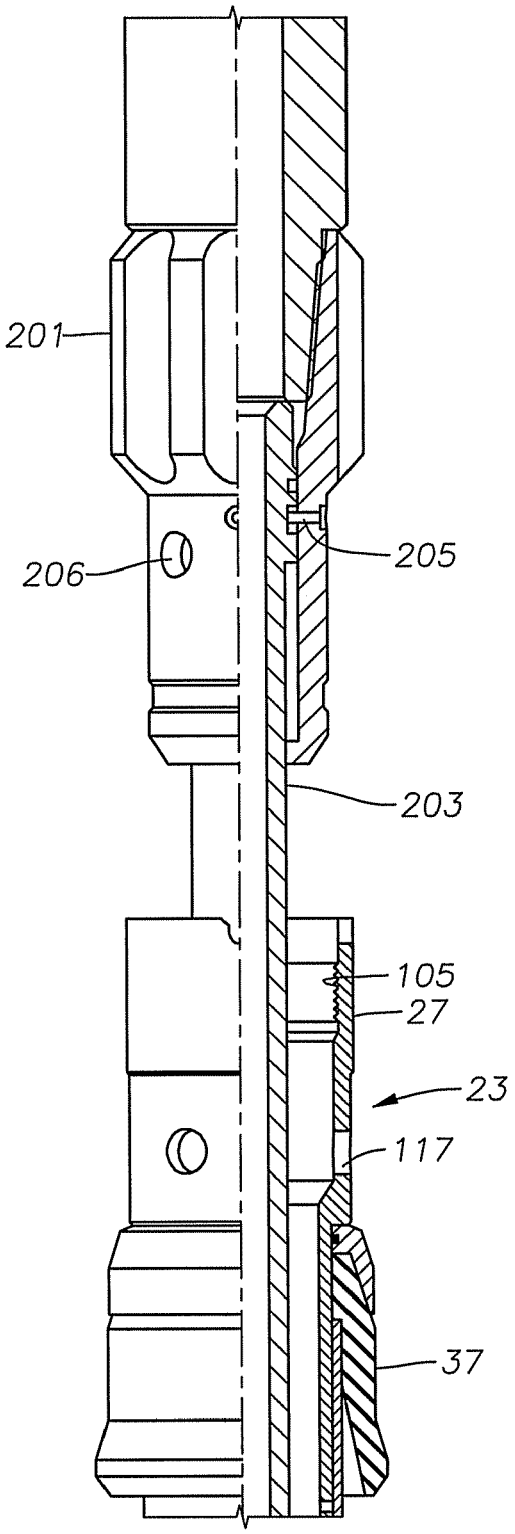
FIGS. 11A-11C comprise a sectional view of the retrieval tool of FIGS. 10A-10B and showing a subsequent sequence.
Figure 11B:
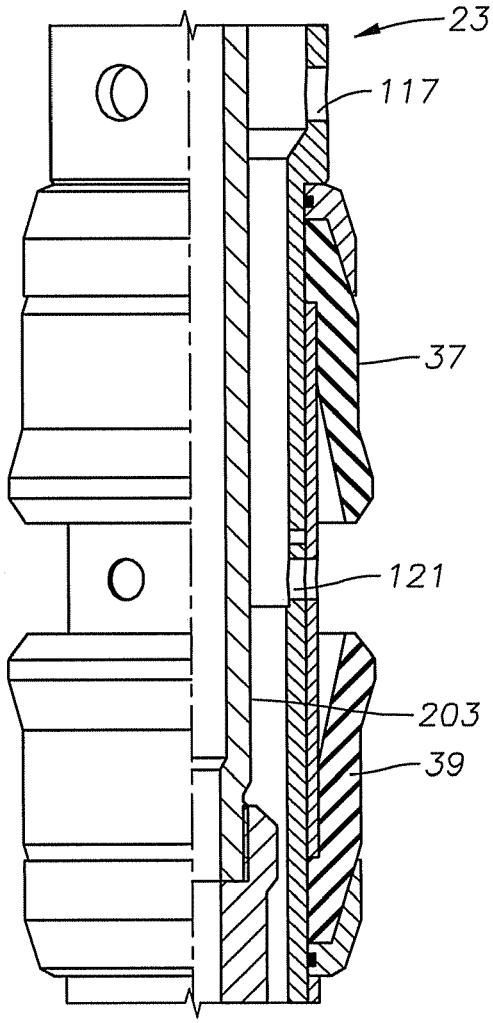
Figure 11C:
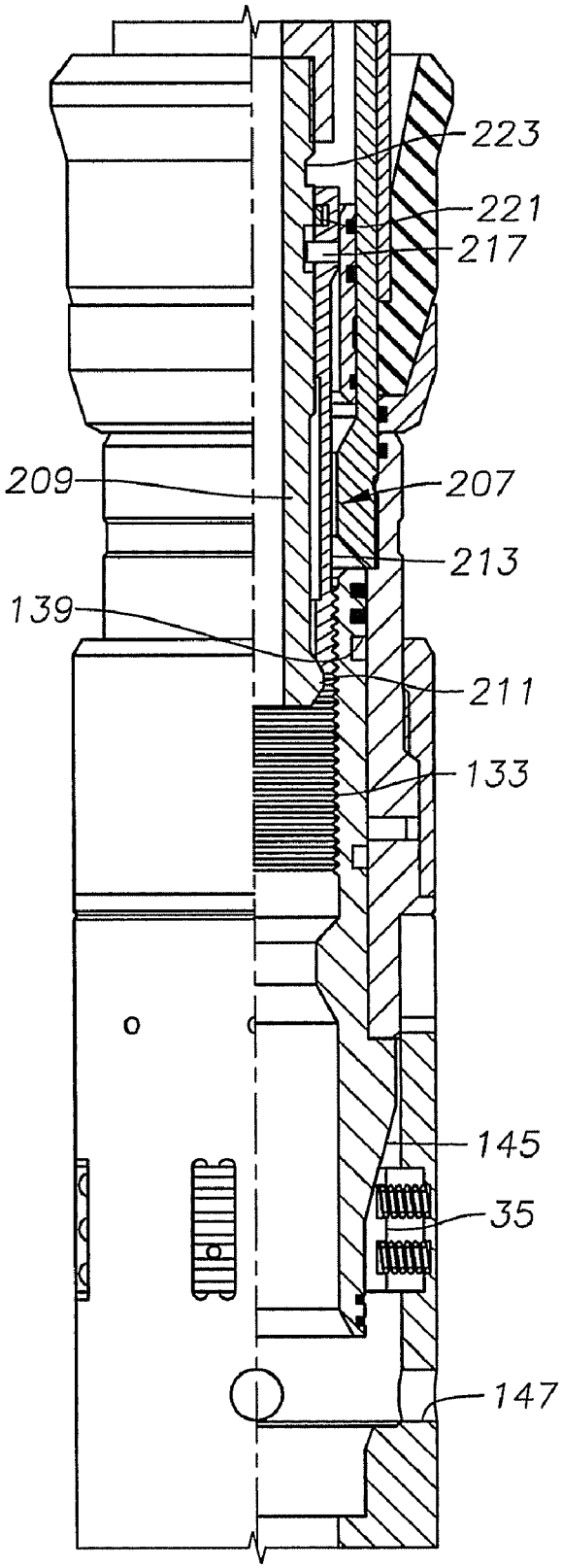

A grapple 207 is attached to the lower end of latch mandrel 203 as shown in FIG. 10B. Grapple 207 may be the same as grapple 175 (FIG. 5C). Grapple 207 has a collet support member 209 with a shoulder 211 on its lower end. A collet 213 is carried on collet support member 209. Collet 213 has gripping members 215 that are radially flexible. Shear pins 217 engage elongated slots 219 in collet support member 209. A snap ring 221 is carried by grapple 207 and urged inward into contact with collet support member 209 at a point below a groove 223 during the normal run-in and retrieval operation.

In a retrieving operation using mechanical retrieval tool 199, as retrieval tool 199 enters DLA 23, it contacts and shears sleeve valve 123. The landed position will position grapple 207 within cam mandrel 129 as shown in FIG. 10B. Picking up the drill string causes collet support 209 to move upward slightly and apply an outward force against gripping members 215 to cause them to tightly engage profile 133 of cam mandrel 129. This upward movement shears spring-biased shear pins 137 and moves cam mandrel 129 to the upper position shown in FIG. 11C. Continued upward movement shears shear pins 205, allowing upper body 201 to move upward relative to the upper enlarged end of latch mandrel 203 until the upper enlarged end contacts an upward facing shoulder on upper body 201. This upward movement opens bypass ports 206 to the interior of latch mandrel 203. Opening bypass ports 206 provides a flow path for annulus fluid above upward facing seals 39 to move below and out ports 147 (FIG. 11C) as DLA 23 is retrieved.

Retrieval tool 199 has the ability to wash and clean the area of cam mandrel 129. If needed, fluid can be circulated at high rates through the drill string and the passage in retrieval tool 199. When the fluid exits, the lower end of retrieval tool 199 will jet and flush solids from the passage in DLA 23, thus making components movable that might otherwise be hampered by solids deposits.

In the event DLA 23 is stuck, weight may be imposed on retrieval tool 199 by the drill pipe. Sufficient weight will shear shear pin 217, allowing collet support 209 to move downward relative to collet 213, which releases gripping members 215 from profile 139 in DLA 23. This downward movement also causes snap ring 221 to snap into groove 223, retaining collet 215 in a position above shoulder 211. Upward pull then lifts retrieval tool 199, leaving DLA 23 in place.

Figure 12:
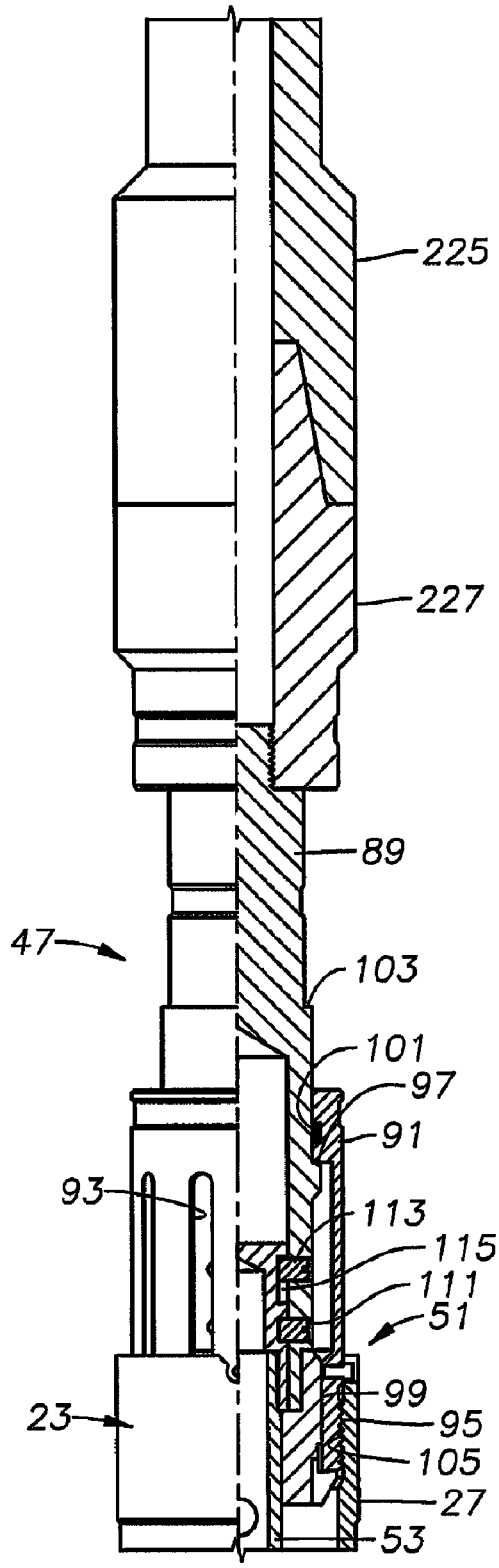
FIG. 12 comprises a sectional view of an upper portion the setting tool of FIGS. 2A-2C configured for being run with drill pipe.

Referring to FIG. 12, DLA 23 could also be installed using drill pipe 225 rather than wireline. To do so, the operator would remove the upper portion of wireline setting tool 47 (FIG. 2B) above latch mandrel 89. The portions removed include poppet valve 61 and upper seal 50. The operator installs an adapter 227 on the drill pipe 225 and connects adapter 227 to the upper end of latch mandrel 89 at the point where lower bypass port housing 85 connected. Unlike the wireline setting operation, the operator does not pump down fluid in the casing to cause DLA 23 to set and the setting tool to release from DLA 23. Instead, after landing DLA 23 in profile sub 25, the operator lowers drill pipe 225 a short distance to cause latching mandrel lower end 135 (FIG. 2C) to push cam mandrel 129 downward to the set position of FIGS. 3C and 3D. The downward movement simultaneously moves latch mandrel base 99 below gripping member 95 (FIG. 3B) to allow it to release from grooved profile 105. The operator then lifts drill pipe 225.

While the invention has been shown in only a few of its forms, it should be apparent to those skilled in the art that it is not so limited but is susceptible to various changes without departing from the scope of the invention.

The invention claimed is:

1. A method of installing a drilling tool at a lower end of a string of casing suspended in a borehole, comprising:

(a) providing a drill lock assembly with a housing, a plurality of axial lock members carried in windows in the housing, a cam member carried within the housing for selective axial movement and having a lower tapered portion and an upper end located below an upper end of the housing;

(b) attaching a drilling tool to the drill lock assembly and the drill lock assembly to a running tool, the running tool having a latch mandrel that extends into the housing of the drill lock assembly and abuts an upward-facing surface of the cam member, and lowering and landing the drill lock assembly into a profile sub in the string of casing;

(c) applying a downward force to the latch mandrel of the running tool to cause the latch mandrel to move the earn member downward relative to the housing of the drill lock assembly, the tapered portion of the cam member pushing the axial lock members outward from a retracted position to an engaged position in engagement with the profile sub; then (d) releasing the running tool from the drill lock assembly and retrieving the running tool along with the latch mandrel.

2. The method according to claim 1, wherein:

releasing the running tool from the drill lock assembly in step (d) occurs simultaneously with the downward movement of the cam member in step (d).

3. The method according to claim 1, further comprising retrieving the drill lock assembly after step (d) by running a retrieval tool downward into engagement with the cam member and pulling upward.

4. The method according to claim 3, wherein the cam member has an interior profile, and running the retrieval tool comprises:

attaching a grapple to the retrieval tool and engaging the grapple with the interior profile by straight downward movement of the retrieval tool relative to the drill lock assembly.

5. A method of installing a drilling tool at a lower end of a string of casing suspended in a borehole, comprising:

(a) securing the drilling tool to a drill lock assembly having a housing, a plurality of axial lock members carried in windows in the housing, a cam member having a tapered lower portion in engagement with the axial lock dogs, and a latch profile in the housing;

(b) providing a setting tool with a latch member and a latch mandrel extending through the latch member, inserting the latch mandrel into the housing of the drill lock assembly into engagement with the cam member and latching the latch member to the housing of the drill lock assembly;

(c) lowering the setting tool and the drill lock assembly down the string of casing and landing the drill lock assembly in a profile sub at the lower end of the string of casing;

(d) moving the latch mandrel downward relative to the latch member and the housing of the drill lock assembly, thereby pushing the cam member downward, the tapered portion pushing the axial lock members from a retracted position to extend radially outward into engagement with the profile sub; and wherein (e) the downward movement of the mandrel simultaneously releases the latch member of the setting tool from the latch profile of the of the housing of the drill lock assembly, enabling the setting tool to be retrieved.

6. The method according to claim 5, wherein step (c) comprises attaching the setting tool to a wireline and lowering the setting tool and the drill lock assembly on the wireline.

7. The method according to claim 5, wherein step (c) comprises attaching the setting tool to a string of pipe and lowering the setting tool and the drill lock assembly on the string of pipe.

8. An apparatus for installing a drilling tool in a profile sub at a lower end of a string of casing suspended in a borehole, comprising:

a drill lock assembly, comprising:

a housing;

a latching profile in the housing of the drill lock assembly;

a threaded lower end for securing to a drilling tool;

at least one torque key to engage the profile sub for torque transmission;

an axially movable cam member carried in the housing for selective axial movement and having a lower tapered portion, the cam member having an upper end located below an upper end of the housing; and an axial lock member that is in engagement with the tapered portion of the cam member and that is moveable radially from a recessed position to an engaged position with the profile sub in response to downward movement of the cam member for locking the drill lock assembly axially to the profile sub;

a setting tool having a latch member releasably coupled to the latching profile of the drill lock assembly for lowering the drill lock assembly down the string of casing and landing the drill lock assembly in the profile sub, the setting tool comprising:

a latch mandrel that extends into the housing of the drill lock assembly in engagement with the cam member, the latch mandrel being downwardly movable relative to the latch member after the drill lock assembly lands in the profile sub, which in turn moves the cam member downward and causes the axial lock member to move to the engaged position; and wherein the downward movement of the latch mandrel also simultaneously releases the latch member of the setting tool from engagement with the latch profile of the drill lock assembly to enable the setting tool to be retrieved.

9. The apparatus according to claim 8, wherein the setting tool is adapted to be coupled to a wireline for lowering and retrieving the setting tool.

10. The apparatus according to claim 8, wherein the setting tool is adapted to be coupled to a string of pipe for lowering and retrieving the setting tool.

11. The apparatus according to claim 8, wherein the latch member of the setting tool comprises:

a collet member mounted on the mandrel, the collet member having gripping members with an external profile that releasably couple to the latching profile of the drill lock assembly;

an enlarged diameter portion on an exterior portion of the mandrel that is located within the gripping members to prevent the gripping members from deflecting inward and releasing from the latch profile while the setting tool and drill lock assembly are being lowered into the string of casing; and wherein downward movement of the mandrel relative to the collet member allows the collet to release from the receptacle.

12. The apparatus according to claim 8, further comprising:

a grooved profile in the housing of the drill lock assembly;

an upward facing shoulder on the latch mandrel of the setting tool;

an enlarged diameter portion on the latch mandrel of the setting tool below the upward facing shoulder;

a collet having an upper solid ring portion that fits around the latch mandrel above the shoulder on the latch mandrel and a set of collet fingers that engage the profile in the housing of the drill lock assembly; wherein the enlarged diameter portion is located radially within the collet fingers to prevent the collet fingers from releasing from the profile in the housing while the setting tool is lowering the drill lock assembly down the casing; and when the latch mandrel moves downward relative to the housing, the enlarged diameter portion moves below the collet fingers to allow the collet fingers to release from the internal profile in the housing.

13. The apparatus according to claim 12, wherein:

the profile in the housing comprises a set of internal threads; and the collet fingers define an external thread that engages the internal threads, allowing the running tool to be secured to the drill lock assembly by relative rotation.

14. The apparatus according to claim 8, further comprising:

a bypass port located in a side wall of the housing of the drill lock assembly below the axial lock member and above the torque key;

a seal on the cam member that is spaced above the bypass port while the cam member is in the upper position and in sealing engagement with a bore of the housing of the drill lock assembly while the cam member is in the lower position.

15. The apparatus according to claim 8, further comprising:

a fixed shear member connected between the cam member and the housing to retain the cam member in the upper position; and a floating shear member mounted in the housing and biased inward into engagement with an exterior surface of the cam member while the cam member is in an upper position, the floating shear member slidingly engaging on the exterior surface of the cam member as the cam member moves from the upper position to a lower position, the cam member having a receptacle that the floating shear member snaps into to retain the cam member in the lower position.

16. An apparatus for installing a drilling tool in a profile sub at a lower end of a string of casing suspended in a borehole, comprising:

a drill lock assembly, comprising:

a housing;

a threaded lower end on the housing for securing to a drilling tool;

at least one torque key mounted to the housing to engage the profile sub for torque transmission;

a cam member carried in the housing for selective axial movement between upper and lower positions and having a tapered portion;

an axial lock member that is in engagement with the tapered portion of the cam member and that is moveable radially from a recessed position to an engaged position with the profile sub in response to downward movement of the cam member for locking the drill lock assembly axially to the profile sub;

a fixed shear member connected between the cam member and the housing to retain the cam member in the upper position; and a floating shear member mounted in the housing and biased inward into engagement with an exterior surface of the cam member while the cam member is in the upper position, the floating shear member slidingly engaging on the exterior surface of the cam member as the cam member moves from the upper position to the lower position, the cam member having a receptacle that the floating shear member snaps into to retain the cam member in the lower position; and a setting tool secured to the drill lock assembly for lowering the drill lock assembly down the string of casing and landing the drill lock assembly in the profile sub, the setting tool comprising:

a latch mandrel that extends into the housing of the drill lock assembly in engagement with the cam member, the latch mandrel being downwardly movable relative to the latch member after the drill lock assembly lands in the profile sub, which in turn moves the cam member downward from the upper position to the lower position and causes the axial lock member to move to the engaged position.

17. The apparatus according to claim 16, wherein the cam member has an upper end recessed within the housing.

18. The apparatus according to claim 16, further comprising:

a grooved profile in the housing of the drill lock assembly;

an upward facing shoulder on the latch mandrel of the setting tool;

an enlarged diameter portion on the latch mandrel of the setting tool below the upward facing shoulder;

a collet having an upper solid ring portion that fits around the latch mandrel above the shoulder on the latch mandrel and a set of collet fingers that engage the profile in the housing of the drill lock assembly; and wherein the enlarged diameter portion is located radially within the collet fingers to prevent the collet fingers from releasing from the profile in the housing while the setting tool is lowering the drill lock assembly down the casing; and when the latch mandrel moves downward relative to the housing, the enlarged diameter portion moves below the collet fingers to allow the collet fingers to release from the internal profile in the housing.

19. The apparatus according to claim 18, wherein:

the profile in the housing comprises a set of internal threads; and the collet fingers define an external thread that engages the internal threads, allowing the running tool to be secured to the drill lock assembly by relative rotation.

20. The apparatus according to claim 16, further comprising:

a bypass port located in a side wall of the housing of the drill lock assembly below the axial lock member and above the torque key; and a seal on the cam member that is spaced above the bypass port while the cam member is in the upper position and in sealing engagement with a bore of the housing of the drill lock assembly while the cam member is in the lower position.

* * * * *